US006993427B2

(12) United States Patent
Ueda

(10) Patent No.: US 6,993,427 B2
(45) Date of Patent: Jan. 31, 2006

(54) COMBUSTION STATE ESTIMATING APPARATUS FOR INTERNAL COMBUSTION ENGINE

(75) Inventor: Koichi Ueda, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 38 days.

(21) Appl. No.: 10/634,812

(22) Filed: Aug. 6, 2003

(65) Prior Publication Data

US 2004/0044461 A1 Mar. 4, 2004

(30) Foreign Application Priority Data

Sep. 3, 2002 (JP) ..... 2002-258134
Sep. 3, 2002 (JP) ..... 2002-258145
Apr. 18, 2003 (JP) ..... 2003-114529

(51) Int. Cl.
*G06G 7/70* (2006.01)

(52) U.S. Cl. ..... 701/111; 701/106; 701/107; 123/179.17; 123/179.16; 123/406.24; 123/491; 123/436; 73/116; 73/117.3

(58) Field of Classification Search ..... 701/101, 701/111, 106, 107, 110, 114, 115; 123/179.16, 123/179.17, 406.23, 406.25, 436, 491; 73/116, 73/117.3

See application file for complete search history.

(56) References Cited

U.S. PATENT DOCUMENTS 5,735,241 A * 4/1998 Matsuura ..... 123/305
5,915,272 A 6/1999 Foley et al. ..... 73/115
6,024,070 A 2/2000 May et al. ..... 123/406.25
6,062,190 A * 5/2000 Nakajima ..... 123/295
6,070,567 A 6/2000 Kakizaki et al. ..... 123/406.25
6,622,692 B2 * 9/2003 Yomogida ..... 123/299

FOREIGN PATENT DOCUMENTS

| | | |
|---|---|---|
| JP | A 9-303243 | 11/1997 |
| JP | A 11-294213 | 10/1999 |
| JP | A 2001-98986 | 4/2001 |
| JP | A 2001-98997 | 4/2001 |
| JP | A 2001-227398 | 8/2001 |
| WO | WO 95/07450 | 3/1995 |

* cited by examiner

*Primary Examiner*—Tony M. Argenbright

*Assistant Examiner*—Johnny H. Hoang

(74) *Attorney, Agent, or Firm*—Oliff & Berridge PLC

(57) ABSTRACT

A combustion state estimating apparatus for estimating the state of combustion in an internal combustion engine includes an angular acceleration calculator that calculates a crank angle acceleration, and a combustion state estimator that estimates the state of combustion in the internal combustion engine based on the crank angle acceleration in a crank angle interval in which an average value of inertia torque caused by a reciprocating inertia mass of the internal combustion engine is substantially zero. Thus, the combustion state estimating apparatus excludes the effect that the inertia torque caused by the reciprocating inertia mass has on the angular acceleration, and therefore is able to precisely estimate the state of combustion based on the angular acceleration.

20 Claims, 18 Drawing Sheets

$T_f$ = function($\Delta T_f$,Map(Ne,thw))

EX.1 $T_f$ = Map(Ne,thw)+ $C_1 \cdot \Delta T_f$

EX.2 $T_f$ = $C_2 \cdot \Delta T_f \cdot$ Map(Ne,thw)

$T_f$ = function($\Delta T_f$ , $\Delta T_f$ ,Map(Ne,thw))

EX.1 $T_f = \text{Map(Ne,thw)} + C_3 \cdot \dfrac{\Delta T_{f1} + \Delta T_{f2}}{2}$

COMBUSTION STATE ESTIMATING APPARATUS FOR INTERNAL COMBUSTION ENGINE

INCORPORATION BY REFERENCE

The disclosure of Japanese Patent Applications No. 2002-258134 filed on Sep. 3, 2002, No. 2002-258145 filed on Sep. 3, 2002 and No. 2003-114529 Apr. 18, 2003 including the specification, drawings and abstract is incorporated herein by reference in its entirety.

BACKGROUND OF THE INVENTION

1. Field of the Invention

The invention relates to a combustion state estimating apparatus for an internal combustion engine, and is applied to an apparatus that estimates the state of combustion from a parameter regarding rotation of a crankshaft.

2. Description of the Related Art

To detect the state of operation of an internal combustion engine, a method of detecting the rotation speed, the angular speed, the angular acceleration, etc. during operation of the engine is employed. For example, Japanese Patent Application Laid-open No. 9-303243 teaches a method in which an angular acceleration of an engine is detected with reference to two predetermined points in the combustion stroke, and a parameter of the engine is adjusted so as to optimize the state of combustion on the basis of the amount of deviation between the all-cylinders average value of angular acceleration and an individual-cylinder average value thereof.

However, the angular acceleration detected outside the engine includes information resulting from the state of combustion, and other various kinds of information, such as the inertia mass of driving portions, the friction thereof, etc. Therefore, the detected angular acceleration does not always agree with the state of combustion. Hence, in some cases, the state of combustion estimated from the angular acceleration includes an error.

Furthermore, according to the method described in the aforementioned patent application, the angular acceleration is evaluated in a relative fashion on the basis of the amount of the deviation between the all-cylinders average value of angular acceleration and the individual-cylinder average value of angular acceleration. Thus, the process for calculating the average values and the amount of deviation is complicated. The measurement of the combustion state through such a relative evaluation is possible only during steady operation of the engine. Therefore, a complicated and cumbersome process needs to be performed; for example, the threshold value used for determination is changed every time the operational condition changes. Therefore, according to the aforementioned conventional method, it is impossible to provide an estimation of the state of combustion corresponding to various operational conditions of the engine, and it is difficult to estimate the state of combustion at an arbitrary timing assuming a real operation of the vehicle.

As for a method for calculating the aforementioned friction torque, the Japanese Patent Application Laid-open No. 11-294213, as for example, teaches calculation of the friction torque using a map of the engine rotation speed and the cooling water temperature.

However, despite the fact that the value of friction torque changes dependent on time and other factors related to environments and the like, the aforementioned method of Patent Application Laid-open No. 11-294213 does not take the time-dependent change in friction torque into consideration, and therefore allows an error in the calculated friction torque in some cases.

SUMMARY OF THE INVENTION

The invention has been accomplished in view of the aforementioned problems. The invention provides a combustion state estimating apparatus for an internal combustion engine which is capable of estimating the state of combustion of the internal combustion engine with high precision by minimizing the effect of factors or information other than the information related to the state of combustion.

The invention provides, as an embodiment, a combustion state estimating apparatus for estimating a state of combustion in an internal combustion engine. The apparatus includes an angular acceleration calculator that calculates a crank angle acceleration, and a combustion state estimator that estimates the state of combustion in the internal combustion engine based on the crank angle acceleration in a crank angle interval in which an average value of inertia torque caused by a reciprocating inertia mass of the internal combustion engine is substantially zero.

In the combustion state estimating apparatus for an internal combustion engine constructed as described above, the state of combustion is estimated on the basis of the angular acceleration in an interval in which the average value of inertia torque caused by the reciprocating inertia mass of the internal combustion engine is substantially zero. Therefore, the combustion state estimating apparatus excludes the effect that the inertia torque caused by the reciprocating inertia mass has on the angular acceleration. Hence, the apparatus allows precise estimation of the state of combustion based on the angular acceleration.

BRIEF DESCRIPTION OF THE DRAWINGS

The above mentioned embodiment and other embodiments, objects, features, advantages, technical and industrial significance of this invention will be better understood by reading the following detailed description of the exemplary embodiments of the invention, when considered in connection with the accompanying drawings, in which.

DESCRIPTION OF THE EXEMPLARY EMBODIMENTS

Figure 1:
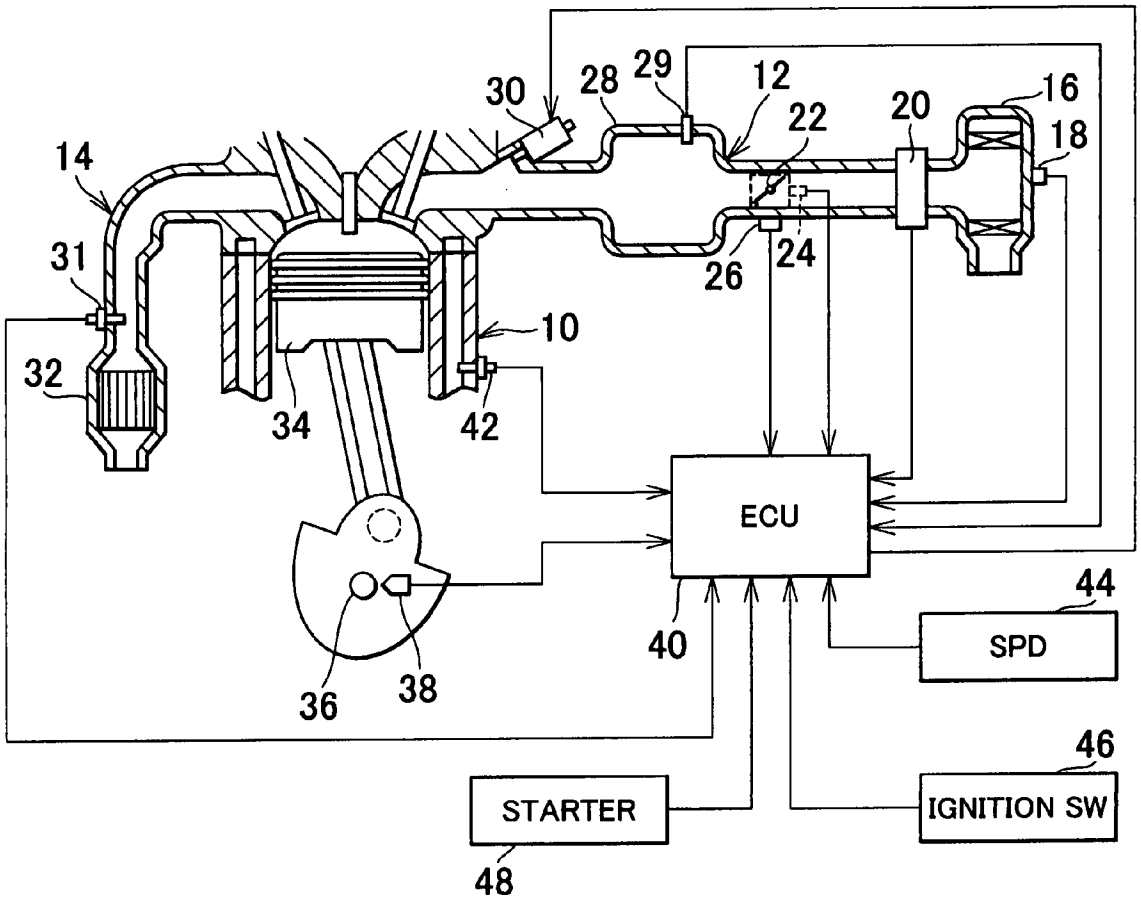
FIG. 1 is a diagram illustrating the structure of a combustion state estimating apparatus of an internal combustion engine according to an embodiment of the invention, and portions around the apparatus.

In the following description and the accompanying drawings, the present invention will be described in more detail in terms of exemplary embodiments. Like components shown in the drawings are represented by like reference characters, and redundant descriptions will be avoided.

FIG. 1 is a diagram illustrating the structure of a combustion state estimating apparatus of an internal combustion engine according to Embodiment 1 of the invention and portions around the apparatus. An intake passageway 12 and an exhaust passageway 14 are connected to an internal combustion engine 10. An air filter 16 is provided in an upstream-side end portion of the intake passageway 12. An intake temperature sensor 18 for detecting the intake air temperature THA (i.e., the external air temperature) is attached to the air filter 16. The exhaust passageway 14 is provided with an exhaust emission control catalyst 32, and an exhaust pressure sensor 31 for detecting the exhaust pressure.

An air flow meter 20 is disposed downstream of the air filter 16. A throttle valve 22 is provided downstream of the air flow meter 20. The throttle valve 22 is formed by, for example, an electronic throttle valve. The degree of opening of the throttle valve 22 is controlled on the basis of a command from an ECU 40. Disposed near the throttle valve 22 are a throttle sensor 24 for detecting the degree of throttle opening TA, and an idle switch 26 that turns on when the throttle valve 22 is completely closed.

A surge tank 28 is provided downstream of the throttle valve 22. An intake pipe pressure sensor 29 for detecting the pressure in the intake passageway 12 (intake pipe pressure) is provided near the surge tank 28. A fuel injection valve 30 for injecting fuel into an intake port of the internal combustion engine 10 is disposed downstream of the surge tank 28.

Each cylinder of the internal combustion engine 10 has a piston 34. The piston 34 is connected to a crankshaft 36 that is rotated by the reciprocating movements thereof. A vehicle drive system and accessories (such as an air-conditioner compressor, an alternator, a torque converter, a power steering pump, etc.) are driven by the rotating torque of the crankshaft 36. A crank angle sensor 38 for detecting the rotational angle of the crankshaft 36 is disposed near the crankshaft 36. A cylinder block of the engine 10 is provided with a water temperature sensor 42 for detecting the cooling water temperature.

The combustion state estimating apparatus of the embodiment has an ECU (electronic control unit) 40. The ECU 40 is connected to the aforementioned various sensors and the fuel injection valve 30, and is also connected to a vehicle speed sensor 44 for detecting the vehicle speed SPD, etc.

An ignition switch 46 for switching the state of the engine between operation and stop, and a starter 48 for rotating the crankshaft 36 by performing the cranking at the time of startup the engine are also connected to the ECU 40. When the ignition switch 46 is changed from an off-state to an on-state, the cranking via the starter 48 is performed, and fuel is injected from the fuel injection valve 30, and is ignited, so as to start up the engine. When the ignition switch 46 is changed from the on-state to the off-state, the fuel injection from the fuel injection valve 30 and the ignition are stopped, so that the engine stops.

A method for estimating the state of combustion of the internal combustion engine 10 will be described in detail with reference to the system shown in FIG. 1. Firstly, mathematical expressions used to estimate the state of combustion will be explained. In the embodiment, the state of combustion is estimated using the following equations (1) and (2).

[Math. 1]

$$T_i = J \cdot \frac{d\omega}{dt} + T_f + T_l \tag{1}$$

$$T_i = T_{gas} + T_{inertia} \tag{2}$$

In the equations (1) and (2), the indicated torque $T_i$ is the torque generated on the crankshaft 36 by combustion in the engine 10. The right-hand side of the equation (2) expresses torques that form the indicated torque $T_i$. The right-hand side of the equation (1) expresses torques that consume the indicated torque $T_i$.

In the right-hand side of the equation (1), J represents the inertia moment of the driving members driven by the combustion of air-fuel mixture and the like, and $d\omega/dt$ represents the angular acceleration of the crankshaft 36, and $T_f$ represents the friction torque of the driving portion, and the $T_l$ represents the load torque from the road surface during the run of the vehicle. $J\times(d\omega/dt)$ is the dynamic lost torque ($=T_{ac}$) attributed to the angular acceleration of the crankshaft 36. The friction torque $T_f$ is the torque caused by mechanical frictions of various connecting portions, such as the friction between the piston 34 and a cylinder inner wall, and the like, and includes the torque caused by mechanical frictions of accessories. The load torque $T_l$ is the torque caused by external disturbance, such as the state of the road during the run of the vehicle, and the like. In the embodiment, the state of combustion is estimated while the transmission gear is set in a neutral state. Therefore, $T_l=0$ is assumed in the description below.

In the right-hand side of the equation (2), $T_{gas}$ represents the torque caused by the gas pressure in the cylinder, and $T_{inertia}$ represents the inertia torque caused by the reciprocating inertia mass of the piston 34, and the like. The torque $T_{gas}$ caused by the in-cylinder gas pressure is generated by the combustion of air-fuel mixture in the cylinder. In order to accurately estimate the state of combustion, it is necessary to determine the torque $T_{gas}$ caused by the in-cylinder gas pressure.

As expressed by the equation (1), the indicated torque $T_j$ can be determined as the sum of the dynamic lost torque $J\times d\omega/dt$ attributed to the angular acceleration, the friction torque $T_f$, and the load torque $T_1$. However, since the indicated torque $T_i$ is not equal to the torque $T_{gas}$ caused by the in-cylinder gas pressure as indicated by the equation (2), it is impossible to precisely estimate the state of combustion from the indicated torque $T_i$.

Figure 2:
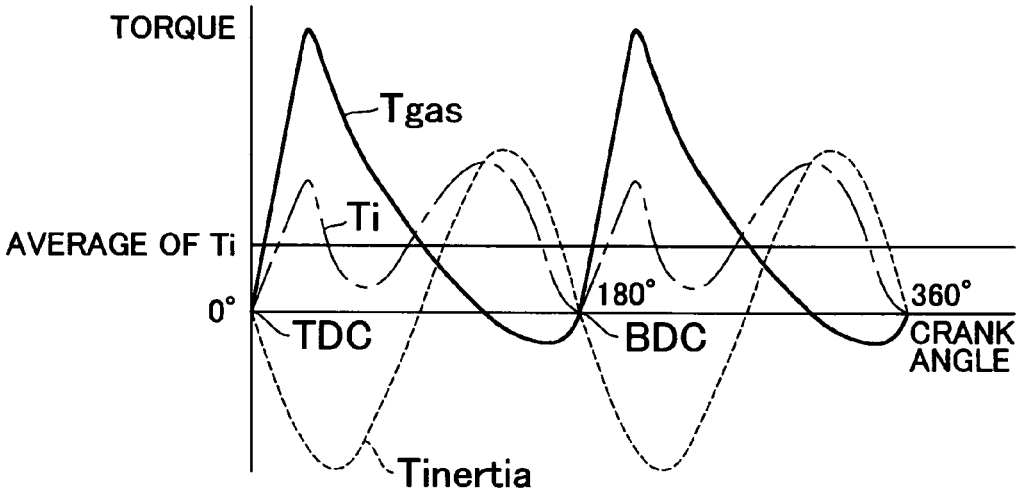
FIG. 2 is a characteristic diagram indicating relationships between the crank angle and the indicated torque, the torque caused by the in-cylinder gas pressure, and the inertia torque caused by the reciprocating inertia mass.

FIG. 2 is a characteristic diagram indicating relationships between the various torques and the crank angle. In FIG. 2, the vertical axis indicates the magnitude of torque, and the horizontal axis indicates the crank angle. Furthermore, a one-dot chain line indicates the indicated torque $T_i$, and a solid line indicates the torque $T_{gas}$ caused by the in-cylinder gas pressure, and a broken line indicates the inertia torque $T_{inertia}$ caused by the reciprocating inertia mass. FIG. 2 indicates characteristics in the case of a four-cylinder engine. In FIG. 2, TDC and BDC indicate the crank angle (0°) at which the piston 34 of one of the four cylinders is at the top dead center (TDC) and the crank angle (180°) at which the piston 34 of the same cylinder is at the bottom dead center (BDC). If the internal combustion engine 10 is a four-cylinder engine, the engine undergoes an explosion piston stroke at every rotational angle of 180° of the crankshaft 36. For every explosion process, the torque characteristic from the TDC to the BDC indicated in FIG. 2 appears.

As indicated by the solid line in FIG. 2, the torque $T_{gas}$ caused by the in-cylinder gas pressure sharply increases and decreases between the TDC and the BDC. The sharp increase in the torque $T_{gas}$ is caused by the explosion of a mixture in the combustion chamber during the explosion stroke. After the explosion, the torque $T_{gas}$ decreases, and assumes negative values due to the influences of the cylinders undergoing the compression stroke or the exhaust stroke. Then, when the crank angle reaches the BDC, the change in the capacity of the cylinder becomes zero, so that the torque $T_{gas}$ assumes the value of 0.

The inertia torque $T_{inertia}$ caused by the reciprocating inertia mass is an inertia torque generated by the inertia mass of the reciprocating members, such as the pistons 34 and the like, and is substantially irrelevant to the torque $T_{gas}$ caused by the in-cylinder gas pressure, or is irrelevant thereto so that the effect of the torque $T_{gas}$ on the inertia torque $T_{inertia}$ is ignorable. The reciprocating members undergo acceleration-deceleration cycles, and the inertia torque $T_{inertia}$ always occurs as long as the crankshaft 36 rotates, even if the angular speed is constant. As indicated by the broken line in FIG. 2, the reciprocating members are at a stop and therefore, $T_{inertia}=0$, when the crank angle is equal to the TDC. As the crank angle changes from the TDC toward the BDC, the reciprocating members start moving from the stopped state. Due to the inertia of the reciprocating members, the torque $T_{inertia}$ increases in the negative direction. When the crank angle reaches the vicinity of 90°, the reciprocating members are moving at a predetermined speed, and therefore the crankshaft 36 continues rotating due to the inertia of the members. Therefore, the torque $T_{inertia}$ changes from the negative side to the opposite side between the TDC and the BDC. After that, when the crank angle reaches the BDC, the reciprocating members stop, and the inertia torque $T_{inertia}$ becomes equal to zero.

As indicated in the equation (2), the indicated torque $T_i$ is the sum of the torque $T_{gas}$ caused by the in-cylinder gas pressure and the inertia torque $T_{inertia}$ caused by the reciprocating inertia mass. Therefore, as indicated by the one-dot chain line in FIG. 2, the indicated torque Ti exhibits a complicated behavior in which, between the TDC and the BDC, the indicated torque Ti increases due to increases in the torque Tgas caused by the explosion of mixture, and temporarily decreases, and then increases again due to the inertia torque $T_{inertia}$.

However, in the interval of crank angle of 180° from the TDC to the BDC, the average value of the inertia torque $T_{inertia}$ caused by the reciprocating inertia mass is zero. This is because the members having reciprocating inertia masses undergo opposite-direction movements in the range of crank angle of 0° to the vicinity of 90° and in the crank angle range of the vicinity of 90° to 180°. Therefore, if each of the torques in the equations (1) and (2) is calculated as an average value in the interval of the TDC to the BDC, the indicated torque $T_i$ can be calculated with the reciprocating inertia mass-caused inertia torque $T_{inertia}$ being equal to "0". Hence, the effect of the reciprocating inertia mass-caused inertia torque $T_{inertia}$ on the indicated torque $T_i$ is excluded, so that the state of combustion can be precisely and easily estimated.

If the average value of each torque in the interval of the TDC to the BDC is determined, the average value of the indicated torque $T_j$ becomes equal to the average value of the torque $T_{gas}$ caused by the in-cylinder gas pressure in the equation (2) since the average of the inertia torque $T_{inertia}$ in the same interval is "0". Therefore, the state of combustion can be precisely estimated on the basis of the indicated torque $T_j$.

Furthermore, if an average value of the angular acceleration of the crankshaft 36 in the interval of the TDC to the BDC is determined, the effect of the reciprocating inertia mass on the angular acceleration is excluded from the determination of the angular acceleration since the average value of the inertia torque $T_{inertia}$ in this interval is "0". Therefore, the angular acceleration attributed only to the state of combustion can be computed. Hence, the state of combustion can be precisely estimated on the basis of the angular acceleration.

Figure 3:
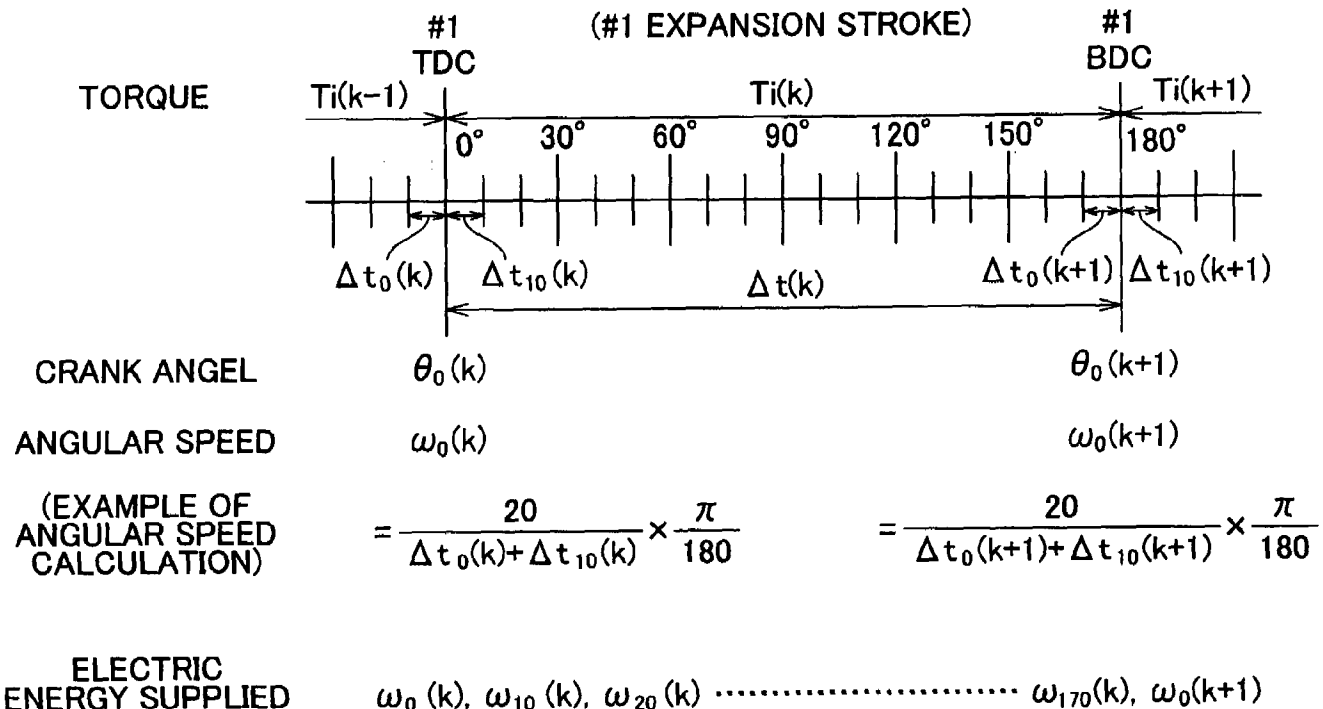
FIG. 3 is a schematic diagram illustrating a method for determining the angular acceleration of a crankshaft.

A method for calculating each torque on the right-hand side of the equation (1) will be described. Firstly, a method for calculating the angular acceleration-caused dynamic lost torque $T_{ac}=J\times(d\omega/dt)$ will be described. FIG. 3 is a schematic diagram illustrating a method for determining the angular acceleration of the crankshaft 36. As indicated in FIG. 3, a crank angle signal via the crank angle sensor 38 is detected at every rotational angle of 10° of the crankshaft 36 in this embodiment.

The combustion state estimating apparatus of the embodiment calculates the angular acceleration-caused dynamic lost torque $T_{ac}$ as an average value in the interval of the TDC to the BDC. To this end, the apparatus of the embodiment determines angular speeds $\omega_0(k)$, $\omega_0(k+1)$ at the two points in crank angle, that is, the TDC and the BDC, and also determines the time $\Delta t(k)$ of the rotation of the crankshaft 36 from the TDC to the BDC.

To determine the angular speed $\omega_0(k)$, for example, the time $\Delta t_0(k)$ and the time $\Delta t_{10}$ (k) of rotation of crank angle 10° preceding and following the TDC are detected via the crank angle sensor 38 as indicated in FIG. 3. Since the crankshaft 36 turns 20° in the time $\Delta t_0(k)+\Delta t_{10}(k)$, $\omega_0(k)$ [rad/s] can be determined from the equation of $\omega_0(k)=(20/(\Delta t_0(k)+\Delta t_{10}(k))\times(\pi/180)$. Likewise, to determine the angular speed $\omega_0(k+1)$, the time $\Delta t_0(k+1)$ and the time $\Delta t_{10}(k+1)$ of rotation of crank angle 10° preceding and following the BDC are detected. Then, $\omega_0(k+1)$ [rad/s] is determined from the equation of $\omega_0)(k+1)=(20/(\Delta t_0(k+1)+\Delta t_{10}(k+1))\times(\pi/180)$.

After the angular speeds $\omega_0(k)$ and $\omega_0(k+1)$ are determined, the calculation of $(\omega_0(k+1)-\omega_0(k))/\Delta t(k)$ is executed to determine an average value of angular acceleration over the duration of rotation of the crankshaft 36 from the TDC to the BDC.

After the average value of angular acceleration is determined, the average value of angular acceleration and the inertia moment J are multiplied according to the right-hand side of the equation (1). In this manner, an average value of the dynamic lost torque $J\times(d\omega/dt)$ during the rotation of the crankshaft 36 from the TDC to the BDC can be calculated. It is to be noted herein that the inertia moment J of the driving portion is determined beforehand from the inertia mass of the driving component parts.

Figure 4:
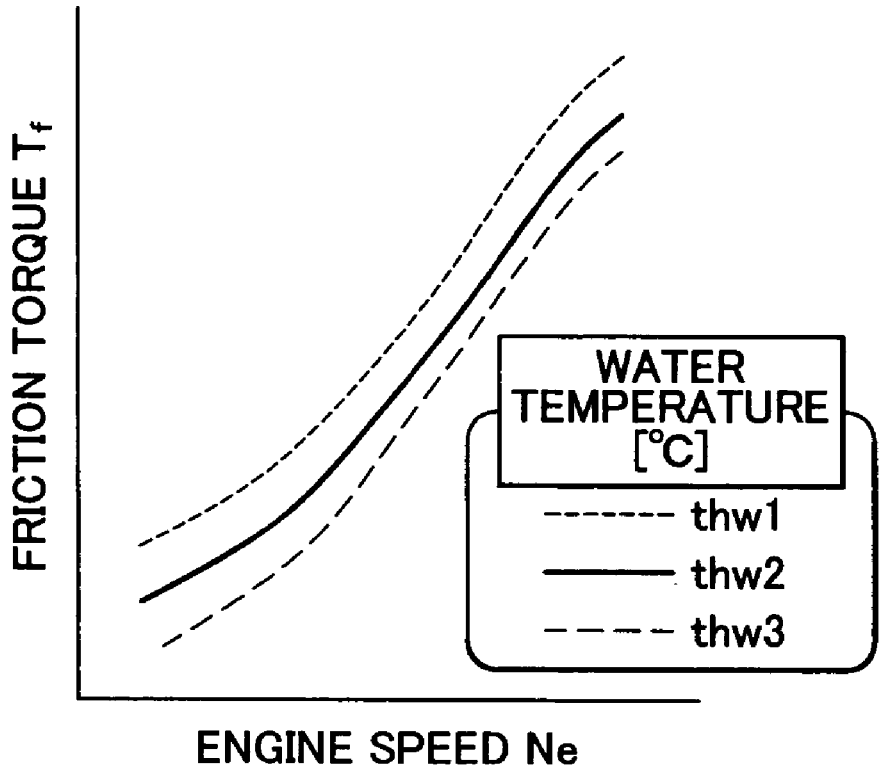
FIG. 4 is a schematic diagram illustrating a map that indicates relationships among the friction torque, the engine rotation speed, and the cooling water temperature.

A method for calculating the friction torque $T_f$ will next be described. FIG. 4 is a map indicating relationships among the friction torque $T_f$, the engine rotation speed (Ne) of the internal combustion engine 10, and the cooling water temperature (thw). In FIG. 4, the friction torque $T_f$, the engine rotation speed (Ne) and the cooling water temperature (thw) are the average values for the duration of rotation of the crankshaft 36 from the TDC to the BDC. The friction torque $T_f$ is the torque caused by the mechanical friction of the connecting portions, such as friction between the piston 34 and the cylinder inner wall, and includes the torque caused by the mechanical friction of accessories.

The cooling water temperature becomes higher in the order of thw1→thw2→thw3. As indicated in FIG. 4, the friction torque $T_f$ tends to increase with increases in the engine rotation speed (Ne), and to increase with decreases in the cooling water temperature (thw). The map shown in FIG. 4 is prepared beforehand by measuring friction torques $T_f$ generated during rotation of the crankshaft 36 from the TDC to the BDC with varied values of the engine rotation speed (Ne) and the cooling water temperature (thw), and determining average values of the measured friction torques $T_f$. To estimate the state of combustion, an average value of the friction torque $T_f$ corresponding to the average value of the cooling water temperature (thw) and the average value of the engine rotation speed in the interval of the TDC to the BDC is determined from the map shown in FIG. 4. As for this operation, the cooling water temperature is detected via the water temperature sensor 42, and the engine rotation speed is detected via the crank angle sensor 38.

The behavior of the friction torque $T_f$ associated with changes in the crank angle is very complicated, and the variation thereof is great. However, the behavior of the friction torque $T_f$ is mainly dependent on the speed of the piston 34. In the case of a four-cylinder engine, each one of the four strokes is experienced sequentially by the four cylinders at intervals of 180° in crank angle, and therefore, the average value of speed of the four pistons 34 in a crank angle interval of 180° is substantially equal to the average value in the subsequent crank angle interval of 180°. Therefore, in the case of a four-cylinder engine, the interval from the TDC (top dead center) to the BDC (bottom dead center), or from the BDC to the TDC, is an interval in which the average value of the inertia torque $T_{inertia}$ caused by the reciprocating inertia mass is "0", and the average values of the friction torque $T_f$ in such intervals are substantially uniform. Therefore, if an average value of the friction torque $T_f$ is determined for every interval (TDC→BDC) in which the average value of the inertia torque $T_{inertia}$ caused by the reciprocating inertia mass is "0", it becomes possible to precisely detect a relationship among the engine rotation speed (Ne), the cooling water temperature (thw), and the friction torque $T_f$, which exhibits complicated transient behaviors. The handling of the friction torque $T_f$ as the average value for every interval will allow accurate map formation as indicated in FIG. 4.

Therefore, the map of FIG. 4 has been prepared by varying the engine rotation speed (Ne) and the cooling water temperature (thw) as parameters, and measuring the friction torque $T_f$ that occurs during rotation of the crankshaft 36 from the TDC to the BDC, and calculating an average value thereof. The values of the engine rotation speed (Ne) and the cooling water temperature (thw) in FIG. 4 are average values thereof for the TDC-BDC interval, similar to the values of the friction torque $T_f$.

More specifically, the interval that allows stable determination or computation of the friction torque $T_f$ is an interval in which the average value of the inertia torque caused by the reciprocating inertia mass of the engine, for example, the pistons 34 and the like, is "0". In the interval where the average value of the inertia torque is "0", the inertia torques caused by the members having reciprocating inertia masses of the individual cylinders offset one another, the average values of speed of the pistons 34 for individual intervals are substantially equal to one another. In the foregoing embodiment, the torque computation interval is an interval of crank angle of 18° between the TDC and the BDC, assuming that the engine 10 is a four-cylinder engine. However, if the invention is applied to an internal combustion engine having a different number of cylinders, the torque computation interval may be an interval where the average value of the inertia torque caused by the reciprocating inertia mass becomes "0".

The ECU 40 stores a map as indicated in FIG. 4 in a memory. The ECU 40 estimates a friction torque $T_f$ through the use of the map, and uses the estimated value for calculation of the indicated torque, and the like. To estimate the friction torque $T_f$, an average value of the friction torque $T_f$ in the TDC-BDC interval is determined on the basis of the TDC-BDC interval average value of the cooling water temperature and the TDC-BDC interval average value of the engine rotation speed, with reference to the map of FIG. 4. For this operation, the cooling water temperature and the engine rotation speed are detected via the water temperature sensor 42 and the crank angle sensor 38, respectively. Thus, the friction torque $T_f$ in the TDC-BDC interval can be accurately estimated, and therefore, the indicated torque can be accurately determined on the basis of the friction torque $T_f$, as described below.

The friction torque $T_f$ includes the torque caused by the friction of accessories, as mentioned above. The value of torque caused by the friction of accessories changes depending on whether the accessories are in operation. For example, an air-conditioner compressor, that is, one of the accessories, receives rotations transmitted from the engine via a belt or the like, so that a torque is caused by friction even if the air-conditioner is not in operation.

If an accessory is operated, for example, if the air-conditioner is switched on, the torque consumed by the compressor becomes greater than in the state where the air-conditioner is not operated. Therefore, the torque caused by friction of the accessories increases, that is, the value of the friction torque $T_f$ increases. Hence, to accurately determine the friction torque $T_f$, it is desirable that the state of operation of the accessories be detected, and that if an accessory is switched on, the value of the friction torque $T_f$ determined from the map of FIG. 4 be corrected.

At the time of very cold startup of the engine or the like, it is more preferable to factor in the difference between the cooling water temperature and the temperature of a site where a friction torque $T_f$ actually occurs, when correcting the friction torque $T_f$. In this case, it is desirable to perform the correction factoring in the amount of fuel introduced into the cylinder, and the elapsed time after the cold startup, etc.

Figure 5:
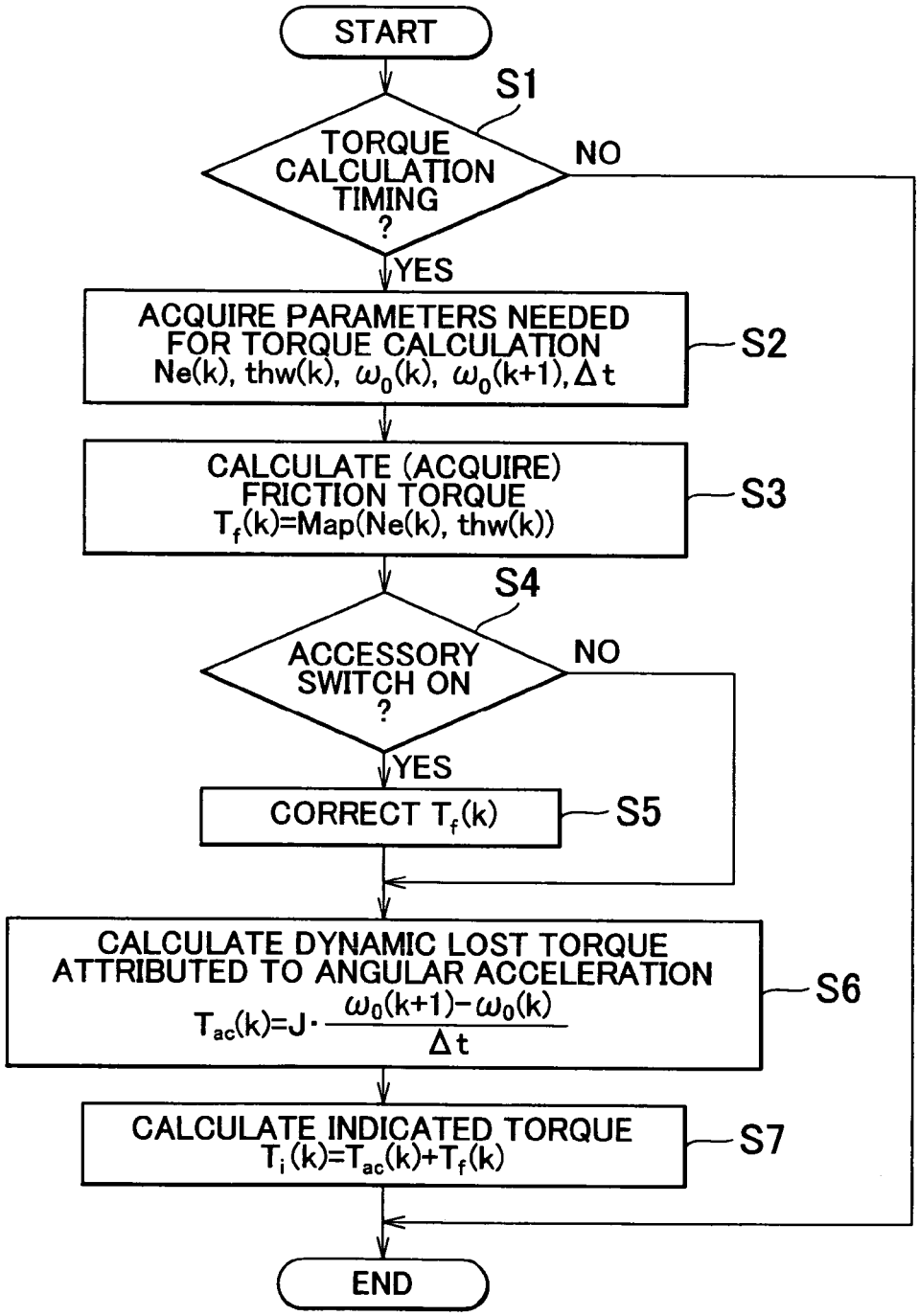
FIG. 5 is a flowchart illustrating the procedure of a process performed by the combustion state estimating apparatus.

A process performed by the combustion state estimating apparatus of the embodiment will next be described with referent to a flowchart shown in FIG. 5. First in step S1, it is determined whether the crank angle has reached a torque calculation timing. More specifically, it is determined whether the present crank angle is in the state where the crank angle is equal to or greater than TDC+10° or the state where the crank angle is equal to or greater than BDC+10°. If the present crank angle corresponds to the torque calculation timing, the process proceeds to step S2. If the present crank angle does not correspond to the torque calculation timing, the process ends.

Subsequently in step S2, parameters needed for torque calculation are acquired. The parameters acquired include the engine rotation speed (Ne(k)), the cooling water temperature (thw(k)), the angular speeds ($\omega_0(k)$, $\omega_0(k+1)$), the time ($\Delta t$), etc.

Subsequently in step S3, a friction torque $T_f(k)$ is calculated. As mentioned above, the friction torque $T_f(k)$ is a function of the engine rotation speed (Ne(k)) and the cooling water temperature (thw(k)), and an average value of the friction torque $T_f$ in the interval of the TDC to the BDC is determined from the map of FIG. 4.

Subsequently in step S4, it is determined whether the switch of an accessory is on. If the switch is on, the process proceeds to step S5, in which the friction torque $T_f(k)$ determined in step S3 is corrected. Specifically, the friction torque $T_f(k)$ is corrected by, for example, a method of multiplying $T_f(k)$ by a predetermined correction factor, or a method of adding a predetermined correction value to $T_f(k)$, etc. If it is determined that the switch of an accessory is off, the process proceeds to step S6.

In step S6, a dynamic lost torque $T_{ac}(k)$ attributed to angular acceleration is calculated. In this case, through the calculation of $T_{ac}(k)=J\times(\omega_0(K+1)-\omega_0(k))/\Delta t$, the average value $T_{ac}(k)$ of dynamic lost torque in the interval of the TDC to the BDC is determined.

Subsequently in step S7, the indicated torque $T_i(k)$ calculated. In this case, $T_i(k)$ is calculated as in $T_i(k)=T_{ac}(k)+T_f(k)$. If the friction torque $T_f(k)$ has been corrected by step S5, the corrected friction torque $T_f(k)$ is used in the calculation. The thus-determined indicated torque $T_i(k)$ is an average value obtained in the interval of the TDC to the BDC.

Since in the TDC-to-BDC interval, the average value of the inertia torque $T_{inertia}$ caused by the reciprocating inertia mass is equal to "0", the acquired indicated torque $T_i(k)$ equals the torque $T_{gas}(k)$ caused by the in-cylinder gas pressure as is apparent from the equation (2).

Figure 6:
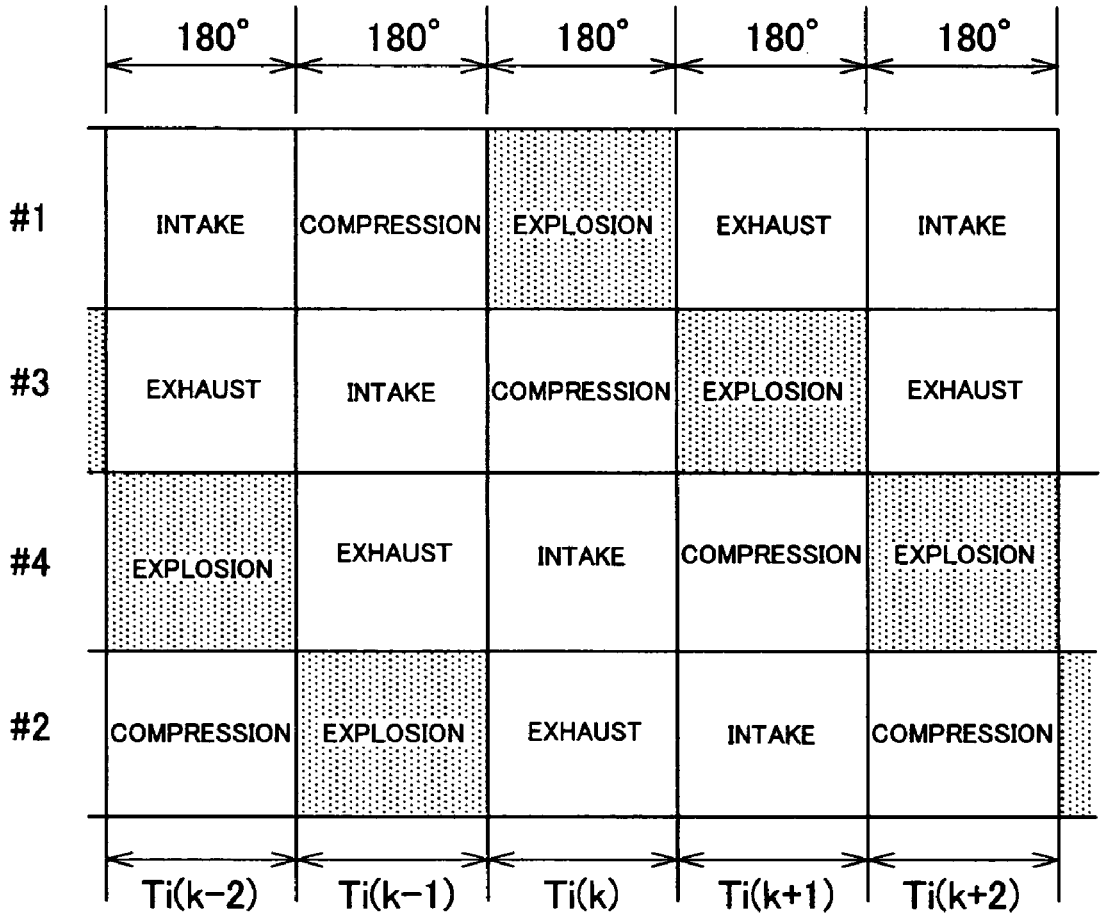
FIG. 6 is a schematic diagram illustrating a relationship between the indicated torque $T_i(k)$ and the strokes of each cylinder.

FIG. 6 is a schematic diagram illustrating a relationship between the calculated indicated torque $T_i(k)$ ($=T_{gas}(k)$) and the strokes of each cylinder. If the internal combustion engine 10 has four cylinders #1 to #4, the explosion stroke occurs at every rotational angle of 180° of the crankshaft 36 in the cylinders in the order of #1, #3, #4 and #2 as shown in FIG. 6. If indicated torques Ti are sequentially calculated in the individual explosion strokes of the engine, that is, at intervals of 180° in crank angle, as shown in FIG. 6, the indicated torque $T_i(k)$ corresponds to the explosion in the cylinder #1. Likewise, the indicated torque $T_i(k-2)$ corresponds to the explosion in the cylinder #4, and the indicated torque $T_i(k-1)$ corresponds to the explosion in the cylinder #2, and the indicated torque $T_i(k+1)$ corresponds to the explosion in the cylinder #3, and the indicated torque $T_i(k+2)$ corresponds to the explosion in the cylinder #4.

At the time of the indicated torque $T_i(k)$, the cylinder #1 undergoes the explosion stroke, and the cylinder #3 undergoes the compression stroke, and the cylinder #4 undergoes the intake stroke, and the cylinder #2 undergoes the exhaust stroke. Since the torques produced by the compression, intake and exhaust strokes are very small compared with the torque produced by the in-cylinder gas pressure generated in the explosion stroke, the indicated torque $T_i$ can be considered equal to the torque $T_{gas}$ caused by the in-cylinder gas pressure generated by explosion in the cylinder #1. Therefore, by calculating the indicated torque in the order of $T_i(k-2)$, $T_i(k-1)$, $T_i(k)$, $T_i(k+1)$, $T_i(k+2)$, the torque $T_{gas}$ produced by the in-cylinder gas pressure caused by explosion in each cylinder can be calculated in the order of #4, #2, #1, #3, #4. Therefore, the state of combustion in each cylinder can be estimated.

Figure 7:
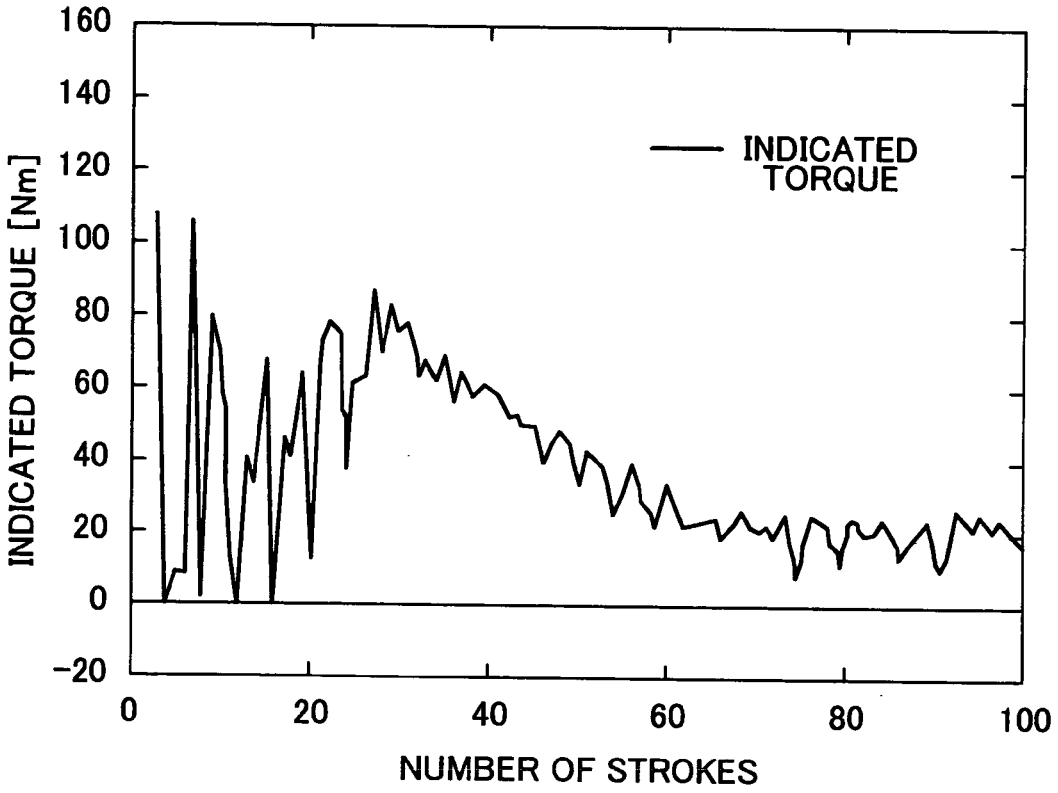
FIG. 7 is a characteristic diagram indicating results of estimation of the indicated torque.

FIG. 7 is a characteristic diagram indicating the calculated indicated torques $T_i(k)$ ($=T_{gas}(k)$) and the number of reciprocating movements (strokes) of each piston 34 immediately following a startup of the engine. This characteristic diagram is obtained by plotting indicated torque $T_i(k)$ estimated for every explosion stroke of the cylinders #1 to #4. Since the combustion state estimating apparatus of the embodiment is able to exclude the effect of the inertia torque $T_{inertia}$ caused by the reciprocating inertia mass and to highly precisely determine the friction torque $T_f$ with reference to a map, the torque $T_{gas}$ generated by the in-cylinder gas pressure can be accurately estimated in absolute value. Therefore, it becomes possible to precisely determine whether the state of combustion is good or bad on the basis of the absolute value of torque even during a state of operation of the engine other than the steady operation, for example, a state immediately following a startup. In FIG. 7, the indicated torque $T_i(k)$ varies to some degree during a period of about 30 strokes immediately following the startup, and therefore it can be determined that the state of combustion is not good during that period.

Figure 8A:
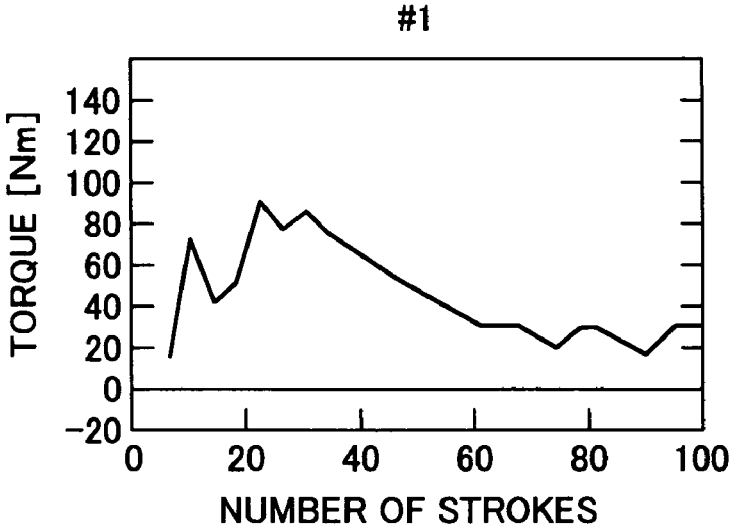
FIG. 8A is a characteristic diagram indicating the results indicated in FIG. 7 with regard to the first cylinder.
Figure 8B:
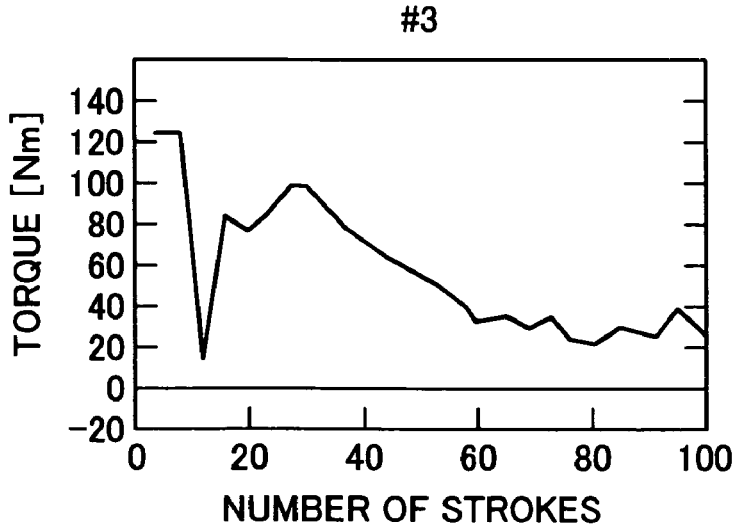
FIG. 8B is a characteristic diagram indicating the results indicated in FIG. 7 with regard to the third cylinder.
Figure 8C:
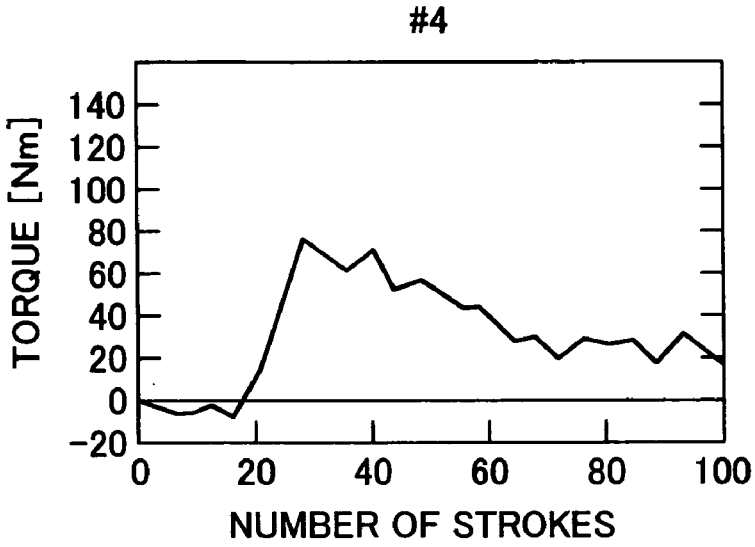
FIG. 8C is a characteristic diagram indicating the results indicated in FIG. 7 with regard to the fourth cylinder.
Figure 8D:
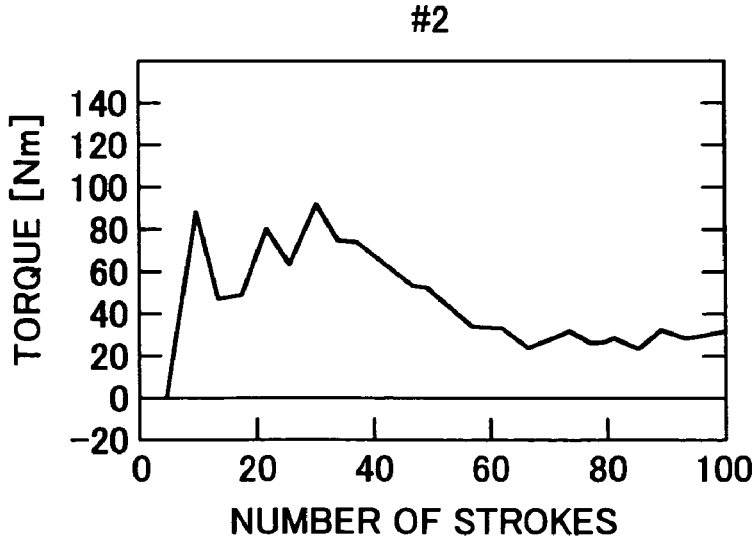
FIG. 8D is a characteristic diagram indicating the results indicated in FIG. 7 with regard to the second cylinder.

FIGS. 8A to 8D are characteristic diagrams indicating the results indicated in FIG. 7 separately for the individual cylinders. The presentation of the indicated torque $T_i$ for each cylinder in this manner makes it possible to estimate the state of combustion in each cylinder. As indicated in FIG. 8C, the cylinder #4 does not produce the indicated torque $T_i$ immediately after the startup of the engine. Therefore, it can be instantly determined that the state of combustion in the cylinder #4 is not good.

Although in the foregoing embodiment, the dynamic lost torque $T_{ac}$ due to angular acceleration is determined from the angular speeds at the TDC and the BDC, it is also possible to divide the interval of the TDC to the BDC into a plurality of small intervals and determine a dynamic lost torque attributed to angular acceleration for each of the divided intervals, and average the dynamic lost torques so as to determine a lost torque $T_{ac}$ for every crank angle of 180°. In a possible method, as for example, the TDC-to-BDC crank angle interval is equally divided into six intervals of 30°, and a dynamic lost torque is determined for every interval of 30° and the determined dynamic lost torques are averaged so as to determine an average value of the dynamic lost torque $T_{ac}$ for the interval of the TDC to the BDC. This method increases the number of points of detection of crank angle speed so as to minimize the error in crank angle detection.

Although in the foregoing embodiment, the interval in which the average value of the inertia torque $T_{inertia}$ caused by the reciprocating inertia mass is "0" is an interval of 180°, the interval that causes the average value of $T_{inertia}$ to be "0" may be set as a broader interval. In the case of a four-cylinder engine, the minimum interval in which the average value of the inertia torque $T_{inertia}$ caused by the reciprocating inertia mass is "0"is an interval of 180°, and therefore, the interval in which the average value of the inertia torque $T_{inertia}$ is "0" may be set at any multiple of 180°. If a low frequency of estimation of the indicated torque Ti is acceptable, for example, if the estimated torque is used for a torque control, a broader angle interval of, for example, 360°, 720° or the like, may be set.

Figure 9A:
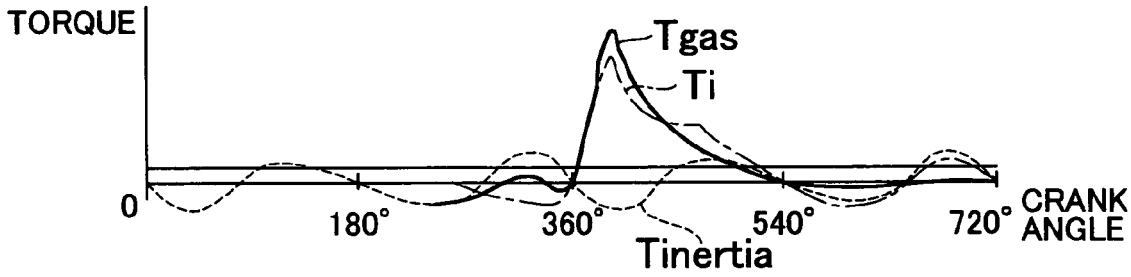
FIG. 9A is a characteristic diagram indicating the torque characteristic of a single-cylinder engine.
Figure 9B:
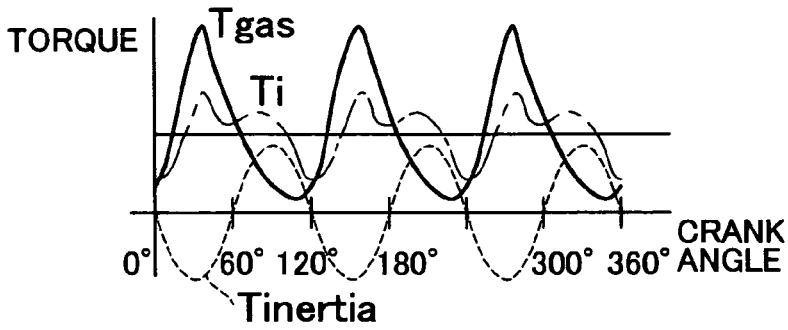
FIG. 9B is a characteristic diagram indicating the torque characteristics of a six-cylinder engine.

Although in the foregoing embodiment, the invention is applied to a four-cylinder internal combustion engine, the state of combustion can also be estimated in internal combustion engines other than the four-cylinder engines in substantially the same manner as in the four-cylinder engines, by determining an interval in which the average value of the torque $T_{inertia}$ caused by the reciprocating inertia mass is "0". FIGS. 9A and 9B are torque characteristic diagrams of internal combustion engines other than the four-cylinder engines, each indicating relationships between the various torques in the equation (2) and the crank angle similarly to FIG. 4. FIG. 9A indicates the torque characteristics of a single-cylinder engine, and FIG. 9B indicates the torque characteristics of a six-cylinder engine.

As indicated in FIG. 9A, the single-cylinder engine undergoes the explosion stroke in every crank angle of 720°, and the torque $T_{gas}$ caused by the in-cylinder gas pressure exhibits a rise and a fall for every event of explosion. The average value of the torque $T_{inertia}$ (dotted line) caused by the reciprocating inertia mass in an interval of 360° to 540° in crank angle is "0". Therefore, if an angular acceleration and an indicated torque are determined for every crank angle interval of 360° to 540°, the state of combustion can be precisely estimated.

Precise estimation of the state of combustion in the six-cylinder engine shown in FIG. 9B can be accomplished in a similar manner. In the six-cylinder engine, the explosion stroke occurs in every crank angle of 720°, and the torque $T_{gas}$ caused by the in-cylinder gas pressure exhibits a rise and a fall in every crank angle of 120°. The average of the inertia torque $T_{inertia}$ caused by the reciprocating inertia mass in a crank angle interval of 0° to 120° is "0". Therefore, if the angular acceleration and the indicated torque are determined at every crank angle of 120°, it becomes possible to exclude the effect of the reciprocating inertia mass and therefore precisely estimate the state of combustion. Since the rotational angle of the crankshaft for a four-stroke cycle is 720°, the range of angle obtained by the calculation of (720°/the number of cylinders) may be set as a minimum unit of the interval in which the average value of the torque $T_{inertia}$ is "0".

Although in the foregoing embodiment, the average values of the crank angle acceleration, the lost torque and the friction torque are calculated in the interval where the average value of the inertia torque $T_{inertia}$ caused by the reciprocating inertia mass is "0", it is also possible to calculate values other than the average values, for example, an integrated value of torque, and the like, in that interval. Since the effect of the torque $T_{inertia}$ is excluded from the interval, this interval allows precise estimation of the state of combustion even if parameters, for example, the integrated value or the like, are used.

In the foregoing embodiment, the load torque $T_l$=10 is assumed to estimate the state of combustion. However, if the load torque $T_l$ is determined on the basis of information from a slope sensor or the like, and is used to estimate the indicated torque $T_i$, it becomes possible to estimate the state of combustion over the entire region of operation while the vehicle is running. Therefore, even in the case of a cold hesitation (startup boggle) of the engine caused by a load change at the time of a cold startup, the state of combustion can be reliably estimated.

The combustion state estimating apparatus of the embodiment calculates the average value of the angular acceleration of the crankshaft 36 in the interval in which the average value of the inertia torque $T_{inertia}$ caused by the reciprocating inertia mass is "0". Thus, the apparatus excludes the effect of the torque $T_{inertia}$ on the angular acceleration. Hence, the apparatus is able to determine the angular acceleration and the dynamic lost torque $T_{ac}$ attributed to the angular acceleration from only the information corresponding to the state of combustion. Furthermore, since the apparatus of the embodiment determines the average value of friction torque in an interval where the average value of the inertia torque $T_{inertia}$ caused by the reciprocating inertia mass is "0", the apparatus is able to accurately determine the friction torque $T_f$ without being affected by transient friction behavior. Therefore, the apparatus can determine the inertia torque $T_i$ corresponding to the state of combustion with high precision, and therefore can precisely estimate the state of combustion based on the indicated torque $T_i$.

The embodiment has been described in conjunction with the case where the parameters regarding time-dependent changes, for example, the total number of operating hours of the internal combustion engine, the number of elapsed years of the engine, the total distance traveled by the vehicle, etc., are relatively small, that is, the case where the time-dependent change in the friction torque $T_f$ is relatively small and the initial state of the engine is substantially maintained.

In reality, however, as the total number of operating hours of the engine increases, a time-dependent change may occur in the friction torque due to increased clearances of sliding portions and the like. Therefore, an error occurs between the actual friction torque and the friction torque $T_f$ determined from the map shown in FIG. 4. A method for more accurately calculating a friction torque if a time-dependent change occurs in the internal combustion engine will next be described. In the method described below, a time-dependent change in the friction torque $T_f$ is calculated at the time of startup of the engine, and the map shown in FIG. 4 is corrected so as to more accurately determine the friction torque.

During the cranking for starting up the engine, the crankshaft 36 is rotated by the starter 48. A control device according to this embodiment determines an actual friction torque $T_{fw}$ that actually occurs during a period following the start of rotation of the crankshaft 36 caused by the cranking and preceding explosion of fuel injected from the fuel injection valve 30. That is, the actual friction torque $T_{fw}$ is determined while the crankshaft 36 is being driven with only the starter 48 serving as a drive power source. Then, the map shown in FIG. 4 is corrected on the basis of the actual friction torque $T_{fw}$. To determined the actual friction torque $T_{fw}$ the following equation (3) is used.

[Math. 3]

$$W_e = J \cdot \frac{d\omega}{dt} + T_{fw} \tag{3}$$

The left-hand side of the equation (3) indicates a torque generated by the starter 48, which is represented by an average value $W_e$ of the electric energy supplied to the starter 48. The right-hand side of the equation (3) indicates the torques that consume the torque generated by the starter 48. Specifically, J represents the inertia moment of the engine, and dω/dt represents the angular acceleration of the crankshaft 36, and $T_{fw}$ represents the actual friction torque that actually occurs at the time of startup of the engine. Furthermore, J×(dω/dt) is a dynamic lost torque (=$T_{ac}$ ) attributed to the angular acceleration of the crankshaft 36 occurring at the time of startup of the engine as mentioned above. Δt the time of startup of the engine, the shift gear is at the neutral position, and an idling operation is performed, so that there occurs substantially no torque, other than $T_{ac}$ and $T_{fw}$, that consumes the torque generated by the starter 48.

In the equation (3), the supplied average electric energy $W_e$ can be determined from the electric power supplied to the starter 48, and the dynamic lost torque $T_{ac}$ attributed to the angular acceleration can be calculated from the angular acceleration of the crankshaft 36. In this case, since the friction torque $T_f$ in the map of FIG. 4 is an average value obtained for the period of rotation of the crankshaft 36 from the TDC to the BDC, the actual friction torque $T_{fw}$, needs to be determined as an average value for this interval. Therefore, the supplied average electric energy $W_e$ and the lost torque $T_{ac}$ are also determined as average values for this interval. Then, by subtracting the lost torque $T_{ac}$ from the supplied average electric energy $W_e$, an average value of the actual friction torque $T_{fw}$ for this interval can be determined.

Therefore, the comparison of the actual friction torque $T_{fw}$, with the friction torque $T_f$ estimated from the map of FIG. 4 allows determination of a time-dependent change in friction torque. Hence, it becomes possible to correct the map while taking the time-dependent change into account.

A method for calculating the supplied average electric energy $W_e$ will next be described. The supplied average electric energy $W_e$ can be determined as an average work provided on the engine by the starter 48 in the calculation interval of the TDC to the BDC. Therefore, the calculation of (average electric energy supplied to the starter [Jule/sec]) ×(calculation interval time Δt [sec]) provides $W_e$ [Jule] makes it possible to determine $W_e$ [Jule]. In this case, the electric energy supplied to the starter 48 fluctuates in accordance with the crank angle; therefore, the calculation interval is divided into a plurality of portions, and the averaging is accomplished as in the following equation (4).

[Math. 4]

$$W_e(k) = \left(\frac{1}{N}\sum_N W\right) \cdot \Delta t \tag{4}$$

In the equation (4), N represents the number of divided calculation intervals, and W represents the electric energy supplied to the starter 48 during each divided interval. In the example indicated in FIG. 3, the calculation interval of the TDC to the BDC is equally divided into intervals of 10° in crank angle, and the electric energies $W_{10}(k), W_{20}(k), \ldots, W_{170}(k), W_0(k+1)$ supplied to the starter 48 during the individual intervals of 10° are determined, and are averaged.

Influential quantities, such as the heat loss of the starter 48, or the like, may be factored in as correction amounts in the calculation of the supplied average electric energy $W_e$. For example, the influence caused by the heat loss is measured or determined beforehand, and is used to correct the calculated electric energy. This manner of calculation makes it possible to determine the supplied average electric energy $W_e$ with higher precision.

Figure 10:
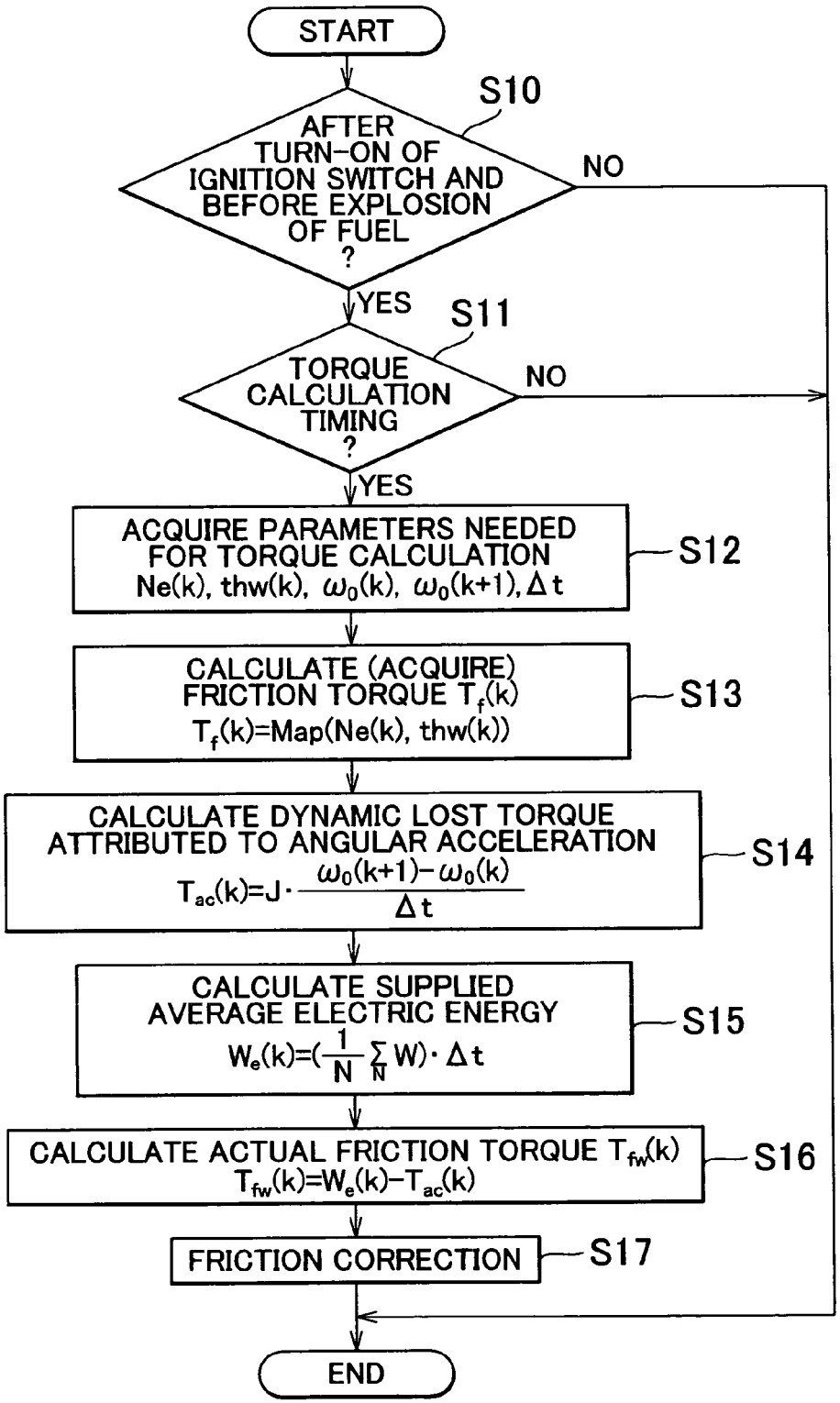
FIG. 10 is a flowchart illustrating the procedure of a process according to a first method for friction torque correction.

The procedure of a process performed by the control device of this embodiment will next be described with reference to the flowchart of FIG. 10. First in step S10, it is determined whether it is presently the time to calculate a friction torque at the time of startup of the engine. Specifically, it is determined whether the present time is after the ignition switch 46 has been changed from an off-state to an on-state and before fuel explodes. If it is determined that it is presently the time to calculate a friction torque at the time of startup of the engine, the process proceeds to step S11. Conversely, if the present time is not the time to calculate a friction torque, the process ends.

In step S11, it is determined whether the present crank angle position coincides with the timing to calculate the lost torque $T_{ac}$. Specifically, it is determined whether the present crank angle is in the state where the crank angle is equal to or greater than TDC+10° or the state where the crank angle is equal to or greater than BDC+10°. If the present crank angle coincides with the torque calculation timing, the process proceeds to step S12. If the present crank angle does not coincide with the torque calculation timing, the process ends.

In step S12, parameters needed for the calculation of torque are acquired. Specifically, the parameters acquired include the engine rotation speed (Ne(k)), the cooling water temperature (thw(k)), the angular speeds ($\omega_0(k)$, $\omega_0(k+1)$), the time (Δt), etc.

Subsequently in step S13, a friction torque $T_f(k)$ is estimated from the map shown in FIG. 4. In this case, the friction torque $T_f(k)$ is determined from the map of FIG. 4 through the use of the engine rotation speed (Ne(k)) and the coolant temperature (thw(k)) acquired in step S12.

Subsequently in step S14, the dynamic lost torque $T_{ac}(k)$ attributed to angular acceleration is calculated. In this case, the average value $T_{ac}(k)$ of dynamic lost torque in the TDC-BDC interval is determined through the calculation of $T_{ac}(k)=J\times((\omega_0(k+1)-\omega_0(k))/\Delta t)$.

Subsequently in step S15, the supplied average electric energy $W_e(k)$ is calculated as in the equation (4). Subsequently in step S16, an actual friction torque $T_{fw}(k)$ is determined by subtracting the lost torque $T_{ac}(k)$ from the supplied average electric energy $W_e(k)$. Thus, the actual friction torque $T_{fw}(k)$ can be determined for every TDC-BDC interval, and execution of the process of steps S11 to S16 in accordance with the rotation of the crankshaft 36 will provide one or more actual friction torques $T_{fw}(k)$, $T_{fw}(k+1)$, . . . .

Subsequently in step S17, the friction torque $T_f$ in the map of FIG. 4 is corrected. Specifically, the actual friction torque $T_{fw}(k)$ determined in step S16 is compared with the friction torque $T_f(k)$ determined in step S13. If there is a difference between the two friction torques, the map shown in FIG. 4 is corrected through the use of the actual friction torque $T_{fw}(k)$ determined in step S16. After the friction torque $T_f$ is corrected in step S17, the process ends.

Figure 11:
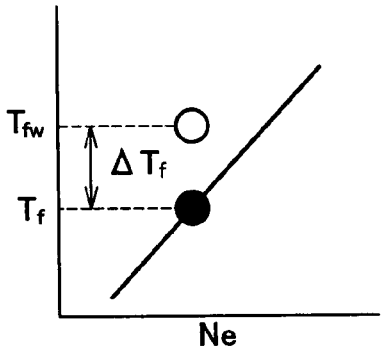
FIG. 11 is a schematic diagram illustrating a method for correction of the friction torque $T_f$.
Figure 12:
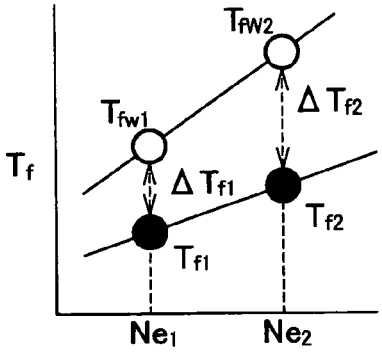
FIG. 12 is a schematic diagram illustrating another method for correction of the friction torque $T_f$.

FIGS. 11 and 12 are schematic diagrams illustrating methods for correcting the map shown in FIG. 4. That is, FIG. 11 illustrates a method in which the map is corrected through the use of an actual friction torque $T_{fw}$. FIG. 12 illustrates a method in which the map is corrected through the use of two actual friction torques $T_{fw}$.

In the method illustrated in FIG. 11, the difference $\Delta T_f$ between the torque $T_f$(=Map(Ne, thw)) obtained from the map and the torque $T_{fw}$ obtained in step S16 is determined, and is used as a correction factor to correct the value $T_f$ of the map. That is, $T_f$ (after correction)=function($\Delta T_f$, Map (Ne, thw)) For example, the value obtained by multiplying the difference $\Delta T_f$ by a predetermined factor $C_1$ is added to the pre-correction torque $T_f$, to determine the post-correction torque $T_f$, as in $T_f$ (after correction)=Map(Ne, thw)+$C_1 \times \Delta T_f$. In another possible manner, the pre-correction torque $T_f$ is multiplied by the value obtained by multiplying the difference $AT_f$ by a predetermined factor $C_2$, to determine the post-correction torque $T_f$, as in $T_f$ (after correction)= $C_2 \times \Delta T_f \times$Map(Ne, thw). According to the method illustrated in FIG. 11, the absolute value of the torque $T_f$ given by the map can be corrected on the basis of the actual friction torque $T_{fw}$.

In the method illustrated in FIG. 12, torque values $T_{fw1}$ and $T_{fw2}$ are used. That is, the difference $\Delta T_{f1}$ between $T_{f1}$ and $T_{fw1}$ and the difference $\Delta T_{f2}$ between $T_{f2}$ and $T_{fw2}$ are determined, and the differences $\Delta T_{f1}$ and $\Delta T_{f2}$ are used as correction factors to correct the value $T_f$ of the map. That is, $T_f$ (after correction)=function ($\Delta T_{f1}$, $\Delta T_{f2}$, Map(Ne, thw)) For example, the value obtained by multiplying the average value of $T_{fw1}$ and $T_{fw2}$ by a predetermined factor $C_3$ is added to the torque $T_f$ obtained from the map, to determine the post-correction torque $T_f$, as in the following equation. $T_f$ (after correction)=Map(Ne, thw)+$C_3 \times ((\Delta T_{f1}+\Delta T_{f2})/2)$ According to the method illustrated in FIG. 12, the absolute value of the torque $T_f$ of the map and the gradient of the torque $T_f$ in the map can be corrected on the basis of the actual friction torques $T_{fw1}$, $T_{fw2}$.

Thus, according to the embodiment, since the values given by the map of FIG. 4 are corrected on the basis of the actual friction torque $T_{fw}$ determined at the time of startup of the engine, the post-correction friction torque $T_f$ can be calculated with high precision even if a time-dependent change occurs in the friction torque.

According to the first method described above, the supplied average electric energy $W_e$ of the starter 48 and the dynamic lost torque $T_{ac}$ attributed to angular acceleration are determined during the state where there is no torque generated by combustion at the time of startup of the engine. Therefore, the actual friction torque $T_{fw}$ that actually occurs at the time of startup of the engine can be determined on the basis of the supplied average electric energy $W_e$ and the lost torque $T_{ac}$. Therefore, if a difference between the friction torque $T_f$ from the map and the actual friction torque $T_{fw}$ is present due to such a factor as a time-dependent change or the like, the friction characteristic of the map can be corrected on the basis of the torque $T_{fw}$, so that the friction torque calculation from the next time on can be more accurately performed. Therefore, degradation of the conformability due to a change in the friction torque $T_f$ can be reduced or prevented. By reflecting the influence of a time-dependent change in the friction characteristic of the map in this manner, it becomes possible to more precisely calculate the characteristic value of the indicated torque $T_i$ in accordance with the flowchart shown in FIG. 5.

A second method for correction of the friction torque $T_f$ will next be described. In this method, an actual friction torque $T_{fw}$ is determined during a period from a time point of the stop of fuel injection and ignition caused by the change of the ignition switch 46 from the on-state to the off-state to a time point of the stop of the engine. Then, as in the above-described first method, the map shown in FIG. 4 is corrected on the basis of the actual friction torque $T_{fw}$ . To determine the actual friction torque $T_{fw}$, the following equation (5) is used.

[Math. 5]

$$0 = J \cdot \frac{d\omega}{dt} + T_{fw} \tag{5}$$

The right-hand side of the equation (5) is the same as that of the equation (3). When the ignition switch 46 is in the off-state, the fuel injection and ignition is stopped, and therefore, there is no torque generated by combustion, as in Embodiment 1. During this state, other torque is not generated either, and therefore, the left-hand side of the equation (5) is "0". Therefore, the actual friction torque $T_{fw}$ can be determined only on the basis of the dynamic lost torque $T_{ac}$ attributed to angular acceleration.

The calculation methods for the angular acceleration and the lost torque $T_{ac}$ are described above. The procedure of a process will next be described with reference to a flowchart shown in FIG. 13. First in step S20, it is determined whether it is presently the time to calculate a friction torque at the time of stop of the engine. Specifically, it is determined whether it is presently after the change of the ignition switch 46 from the on-state to the off-state and after the last explosion of fuel. If it is presently the time to calculate friction torque at the time of stop of the engine, the process proceeds to step S21. Conversely, if it is presently not the time to calculate friction torque, the process ends.

In step S21, it is determined whether the present crank angle position coincides with the timing to calculate the lost torque $T_{ac}$. Specifically, it is determined whether the present crank angle is in either the state where the crank angle is equal to or greater than TDC+10° or the state where the crank angle is equal to or greater than BDC+10°. If the present crank angle coincides with the torque calculation timing, the process proceeds to step S22. If the present crank angle does not coincide with the torque calculation timing, the process ends.

In step S22, parameters needed for the calculation of torque are acquired. Specifically, the parameters acquired include the engine rotation speed (Ne(k)), the coolant temperature (thw(k)), the angular speeds ($\omega_0(k)$, $\omega_0(k+1)$), the time ($\Delta t$), etc.

Subsequently in step S23, a friction torque $T_f(k)$ is estimated from the map shown in FIG. 4. In this case, the friction torque $T_f(k)$ is determined from the map of FIG. 4 through the use of the engine rotation speed (Ne(k)) and the coolant temperature (thw(k)) acquired in step S22.

Subsequently in step S24, the dynamic lost torque $T_{ac}(k)$ attributed to angular acceleration is calculated. In this case, the average value $T_{ac}(k)$ of dynamic lost torque in the TDC-BDC interval is determined through the calculation of $T_{ac}(k)=J\times((\omega_0(k+1)-\omega_0(k))/\Delta t)$.

Subsequently in step S25, the actual friction torque $T_{fw}(k)$ is calculated as in the equation (5). Since the left-hand side of the equation (5) is "0", $T_{fw}(k)=-T_{ac}(k)$. As in Embodiment 1 described above, the actual friction torque $T_{fw}(k)$ can be determined for every TDC-BDC interval, and execution of the process of steps S21 to S25 in accordance with rotation of the crankshaft will provide one or more actual friction torques $T_{fw}(k)$.

Subsequently in step S26, the friction torque $T_f$ of the map of FIG. 4 is corrected. Specifically, the actual friction torque $T_{fw}(k)$ determined in step S25 is compared with the friction torque $T_f(k)$ determined in step S23. If there is a difference between the two friction torques, the map shown in FIG. 4 is corrected through the use of the actual friction torque $T_{fw}(k)$ determined in step S25. The method for the correction may be the same as the method described above with reference to FIG. 11 or 12. After the friction torque $T_f$ is corrected in step S26, the process ends.

According to the second method described above, the dynamic lost torque $T_{ac}$ attributed to angular acceleration is determined during a period from the switching of the ignition switch 46 from the on-state to the off-state until the stop of the engine. Therefore, the actual friction torque $T_{fw}$ that actually occurs at the time of stop of the engine can be determined on the basis of the lost torque $T_{ac}$. Hence, as in Embodiment 1, the friction characteristic of the map can be corrected, and it becomes possible to accurately calculate a characteristic value such as the indicated torque.

If in the first or second method, there is no need to calculate an actual friction torque $T_f$ every time the engine starts or stops, the frequency of calculation of the actual friction torque $T_f$ may be reduced. For example, in a possible manner, a condition for executing a correction logic is determined from a parameter that may cause a change in friction, such as the total distance traveled by the vehicle, the number of elapsed years of the engine, etc., and the actual friction torque $T_{fw}$ is calculated only if the condition is met. This manner of calculation reduces the operation load.

Next, a third method for correction of the friction torque $T_f$ will be described. In the third method, the fuel injection and the ignition are stopped at an arbitrary timing during operation of the engine provided that there is no load on the engine, and during the stop, the actual friction torque $T_{fw}$ is determined. To determine the actual friction torque $T_{fw}$, the equation (4) is used as in the second method.

If the fuel injection and ignition is stopped during operation of the engine, there is no torque generated by combustion. In this state, other torque is not generated either. Therefore, the left-hand side of the equation (5) is "0" as in the second method. Furthermore, during the state where there is no load on the engine, for example, during an idling state or the like, there is no load except the dynamic lost torque $T_{ac}$ and the friction torque $T_{fw}$. Therefore, the actual friction torque $T_{fw}$ can be determined from the equation (5) as in the second method.

For calculation of the actual friction torque $T_{fw}$, a condition for executing a correction logic is determined from a parameter that may cause a change in friction, for example, the total distance traveled by the vehicle, the number of elapsed years of the engine, etc. If the condition is met, the fuel injection and the ignition are stopped to calculate the actual friction torque $T_{fw}$.

Figure 14:
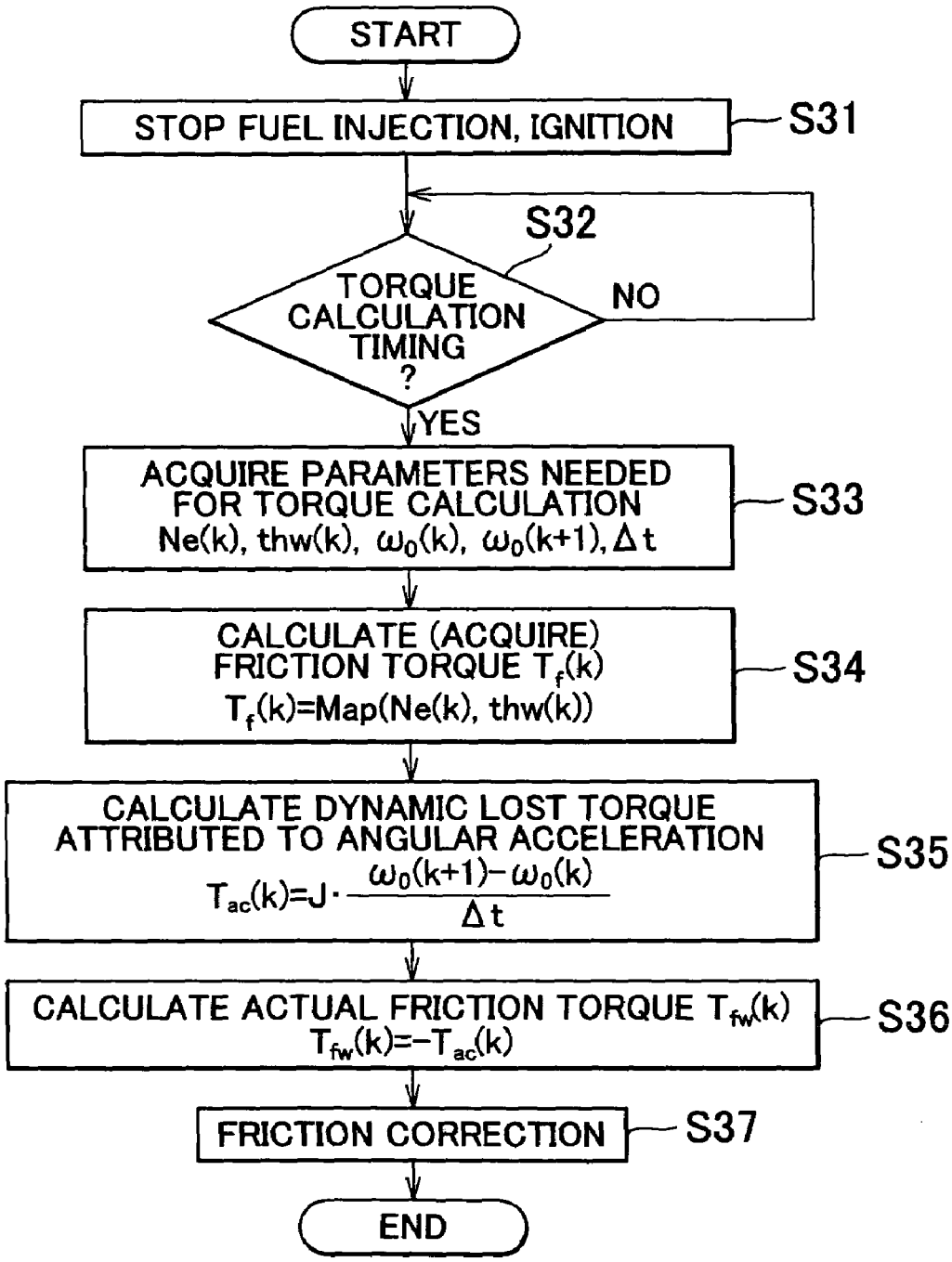
FIG. 14 is a flowchart illustrating the procedure of a process according to a third method for friction torque correction.

The procedure in the third embodiment will be described with reference to a flowchart shown in FIG. 14. First in step S31, the fuel injection from the fuel injection valve 30 is stopped and the ignition of fuel is stopped. Specifically, the fuel injection and the ignition are stopped within a single explosion stroke in an interval for calculation of the lost torque $T_{ac}$.

In step S32, it is determined whether the present crank angle position coincides with the timing to calculate the lost torque $T_{ac}$. Specifically, it is determined whether the present crank angle is in either the state where the crank angle is equal to or greater than TDC+10° or the state where the crank angle is equal to or greater than BDC+10°. If the present crank angle coincides with the torque calculation timing, the process proceeds to step S33. If the present crank angle does not coincide with the torque calculation timing, the waiting occurs in step S32.

In step S33, parameters needed for the calculation of torque are acquired. Specifically, the parameters acquired include the engine rotation speed (Ne(k)), the coolant temperature (thw(k)), the angular speeds ($\omega_0(k)$, $\omega_0(k+1)$), the time ($\Delta t$), etc.

Subsequently in step S34, a friction torque $T_f(k)$ is estimated from the map shown in FIG. 4. In this case, the friction torque $T_f(k)$ is determined from the map of FIG. 4 through the use of the engine rotation speed (Ne(k)) and the coolant temperature (thw(k)) acquired in step S33.

Subsequently in step S35, the dynamic lost torque $T_{ac}(k)$ attributed to angular acceleration is calculated. In this case, the average value $T_{ac}(k)$ of dynamic lost torque in the TDC-BDC interval is determined through the calculation of $T_{ac}(k)=J\times((\omega_0(k+1)-\omega_0(k))/\Delta t)$.

Subsequently in step S36, the actual friction torque $T_{fw}(k)$ is calculated as in the equation (5). Since the left-hand side of the equation (5) is "0", $T_{fw}(k)=-T_{ac}(k)$. The actual friction torque $T_{fw}(k)$ can be determined for every TDC-BDC interval. The execution of the process of steps S31 to S36 in accordance with rotation of the crankshaft will provide one or more actual friction torques $T_{fw}(k)$.

Subsequently in step S37, the friction torque $T_f$ of the map of FIG. 4 is corrected. Specifically, the actual friction torque $T_{fw}(k)$ determined in step S36 is compared with the friction torque $T_f(k)$ determined in step S34. If there is a difference between the two friction torques, the map shown in FIG. 4 is corrected through the use of the actual friction torque $T_{fw}(k)$ determined in step S36. The method for the correction may be the same as the method described above with reference to FIG. 11 or 12. After the friction torque $T_f$ is corrected in step S37, the process ends. In the third method, the actual friction torque $T_{fw}$ can be calculated without restrictions on the engine rotation speed; therefore, the correction based on many points illustrated in FIG. 12 is more suitable.

It is to be noted herein that even if the fuel injection and the ignition are stopped, the pumping loss of the piston 34 may occur, and may affect the calculated value of actual friction torque $T_{fw}$. Therefore, it is desirable that the timing of calculating an angular acceleration coincide with the fully open state of the throttle valve 22. As a result, the pumping loss can be minimized, and it becomes possible to accurately determine the actual friction torque $T_{fw}$ . The pumping loss may also be reduced by the provision of a variable valve system and the closure of intake and exhaust valves, instead of the fully opening of the throttle valve 22.

According to the third method described above, as the fuel injection and the ignition are stopped at an arbitrary timing during operation of the engine, the actual friction torque $T_{fw}$ can be determined from the dynamic lost torque $T_{ac}$ so as to correct the friction characteristic of the map. Furthermore, since the actual friction torque $T_{fw}$ can be determined without restriction on the engine rotation speed, the method allows correction of the friction torque $T_f$ during high-speed rotation as well, and therefore makes it possible to correct the map shown in FIG. 4 with high precision. Therefore, it becomes possible to further improve the precision in estimating the indicated torque.

Although in the foregoing embodiments, the map shown in FIG. 4 is prepared from the engine rotation speed (Ne) and the coolant temperature (thw) for the purpose of determining the friction torque Tf the friction torque Tf may also be determined from information regarding the engine temperature that is acquired from the oil temperature and the like.

A fourth method for correction of the friction torque $T_f$ will next be described. In the second method, the left-hand side of the equation (5) is "0"since no torque is generated by combustion during the state where the ignition switch 46 is off. However, after the ignition switch 46 is turned off, the pistons 34 continue moving back and forth until the engine finally stops. As air is taken into a cylinder due to the reciprocating movements of the piston 34, the intake passageway 12 comes to have a negative pressure, so that a pumping loss occurs in the rotating torque of the crankshaft 36. Therefore, if the torque corresponding to the pumping loss is taken into account, it becomes possible to calculate the actual friction torque Tfw with improved precision.

Likewise, a negative pressure also occurs in the intake passageway 12, and therefore causes a pumping loss, at the time of startup of the engine, and during operation of the engine. Therefore, taking the pumping loss into account allows high-precision calculation of the actual friction torque $T_{fw}$ in the first and third methods as well.

In particular, if the throttle valve 22 is closed, the intake passageway 12 has a greater negative pressure than in the case where the throttle valve 22 is open; therefore, taking the pumping loss into account increases the precision in the calculation of the actual friction torque $T_{fw}$.

According to the fourth method, the actual friction torque $T_{fw}$ is calculated while the pumping loss is factored in, and the map shown in FIG. 4 is corrected with improved precision, in the foregoing embodiments.

Figure 15A:
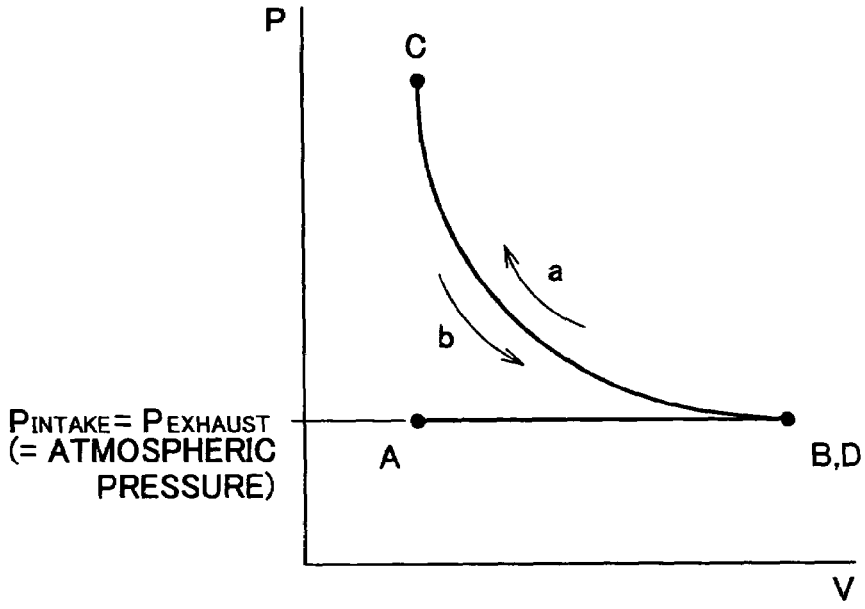
FIG. 15A is a schematic diagram for explanation of the pumping loss, illustrating a case where the throttle valve 22 is fully open
Figure 15B:
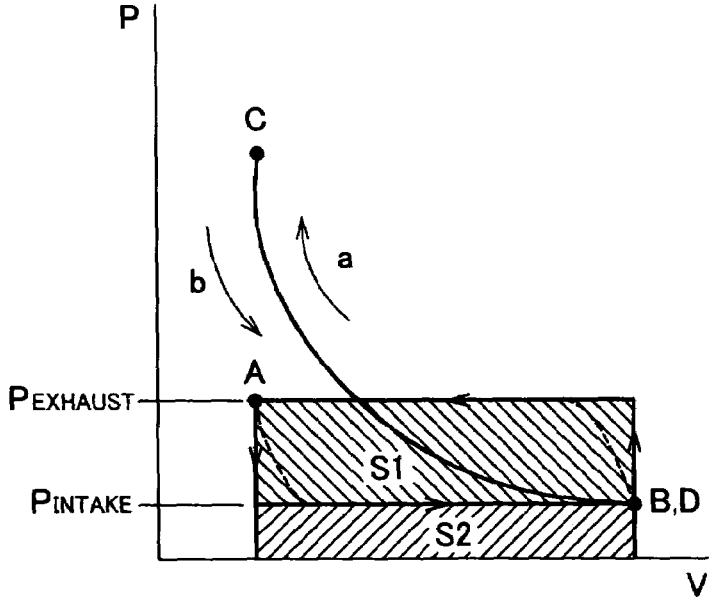
FIG. 15B is a schematic diagram for explanation of the pumping loss, illustrating a case where the throttle valve 22 is completely closed.

FIGS. 15A and 15B are schematic diagrams for explanation of the pumping loss. The pumping loss will be explained in detail with reference to FIGS. 15A and 15B. FIGS. 15A and 15B are characteristic diagrams (P-V graphs) indicating relationships between the pressure P in a cylinder and the capacity V of the cylinder in a case where the cranking is performed by the starter 48 and explosion is not caused in the cylinder. FIG. 15A illustrates a case where the throttle valve 22 is fully open, and FIG. 15B illustrates a case where the throttle valve 22 is completely closed.

In each of FIGS. 15A and 15B, a point A indicates the in-cylinder pressure P and the cylinder capacity V occurring at the beginning of the intake stroke (TDC in crank angle), and a point B indicates the in-cylinder pressure P and the cylinder capacity V occurring at the beginning of the compression stroke (BDC in crank angle), and a point C indicates the in-cylinder pressure P and the cylinder capacity V occurring at the beginning of the explosion (expansion) stroke (TDC in crank angle), and a point D indicates the in-cylinder pressure P and the cylinder capacity V occurring at the beginning of the exhaust stroke (BDC in crank angle).

As indicated in FIG. 15A, during the fully open state of the throttle valve 22, the beginning of the intake stroke at the point A is followed by an increase in the cylinder capacity V. That is, the cylinder capacity V increases with descent of the piston 34, while the in-cylinder pressure remains at $P_{INTAKE}$ (=atmospheric pressure). The in-cylinder pressure P and the cylinder capacity V at the end of the intake stroke are indicated by the point B. After the compression stroke begins at the point B, the P-V characteristic exhibits a transition to the point C along a curve in a direction indicated by an arrow a since the intake and exhaust valves are closed during the compression stroke. After the expansion stroke begins at the point C, the P-V characteristic exhibits a transition to the point D along the curve in a direction (indicated by an arrow b) opposite to the direction of transition exhibited during the compression stroke. Then, after the exhaust stroke begins at the point D, the cylinder capacity decreases with ascent of the piston 34 while the in-cylinder pressure remains at $P_{EXHAUST}$ (=$P_{INTAKE}$); that is, the P-V characteristic exhibits a transition back to the point A along the straight line in the direction opposite to the direction of transition exhibited during the intake stroke.

At the time of increase in the cylinder capacity, a positive amount of work is produced by the gas in the cylinder. At the time of decrease in the cylinder capacity, a negative amount of Work is produced. While the throttle valve 22 is fully open, the intake stroke and the exhaust stroke cause transitions of the P-V characteristic along the same path in the opposite directions, and therefore the sum total of the work produced during the intake stroke and the work produced during the exhaust stroke becomes zero. Likewise, the compression stroke and the expansion stroke cause transitions of the P-V characteristic along the same path in the opposite directions, and therefore, the sum total of the works produced during the compression stroke and during the expansion stroke also becomes zero. Therefore, no pumping loss occurs in the entire four-stroke cycle.

If the throttle valve 22 is completely closed, the beginning of the intake stroke at the point A is initially followed by a fall of the in-cylinder pressure from $P_{EXHAUST}$ to $P_{INTAKE}$ due to occurrence of a negative pressure in the intake passageway 12, as indicated in FIG. 15B. Then, the cylinder capacity increases with descent of the piston 34, while the pressure remains at $P_{INTAKE}$. After the intake stroke ends and the compression stroke begins at the point B, the P-V characteristic exhibits a transition to the point C along a curved path in a direction indicated by an arrow a since the intake and exhaust valves are closed during the compression stroke. After the expansion stroke begins at the point C, the P-V characteristic exhibits a transition to the point D along the same curved path in a direction (indicated by an arrow b) opposite to the direction of transition exhibited during the compression stroke. Subsequently, after the exhaust stroke begins at the point D, the in-cylinder pressure rises to $P_{EXHAUST}$ (=atmospheric pressure) since the exhaust valve is opened. Then, while the in-cylinder pressure remains at $P_{EXHAUST}$, the cylinder capacity decreases with ascent of the piston 34; that is, the P-V characteristic exhibits a transition back to the point A.

Thus, during the completely closed state of the throttle valve 22, the compression stroke and the expansion stroke cause transitions of the P-V characteristic along the same path in the opposite directions whereas the intake stroke and the exhaust stroke cause transitions of the P-V characteristic along different paths. Therefore, while the work produced during the compression stroke and the work produced during the expansion stroke cancel each other and make a total sum of zero, the work produced during the intake stroke and the work produced during the exhaust stroke do not cancel each other but make a negative amount of work. This negative amount of work forms a pumping loss.

More specifically, during the intake stroke, a positive amount of work corresponding to an area $S_2$ indicated by hatching in FIG. 15B is produced. On the other hand, during the exhaust stroke, a negative amount of work corresponding to the sum of the area $S_2$ and an area $S_1$ indicated by hatching in FIG. 15B is produced. Therefore, the sum of the woks produced during the intake stroke and during the exhaust stroke is a negative amount of work corresponding to the area $S_1$.

Figure 16A:
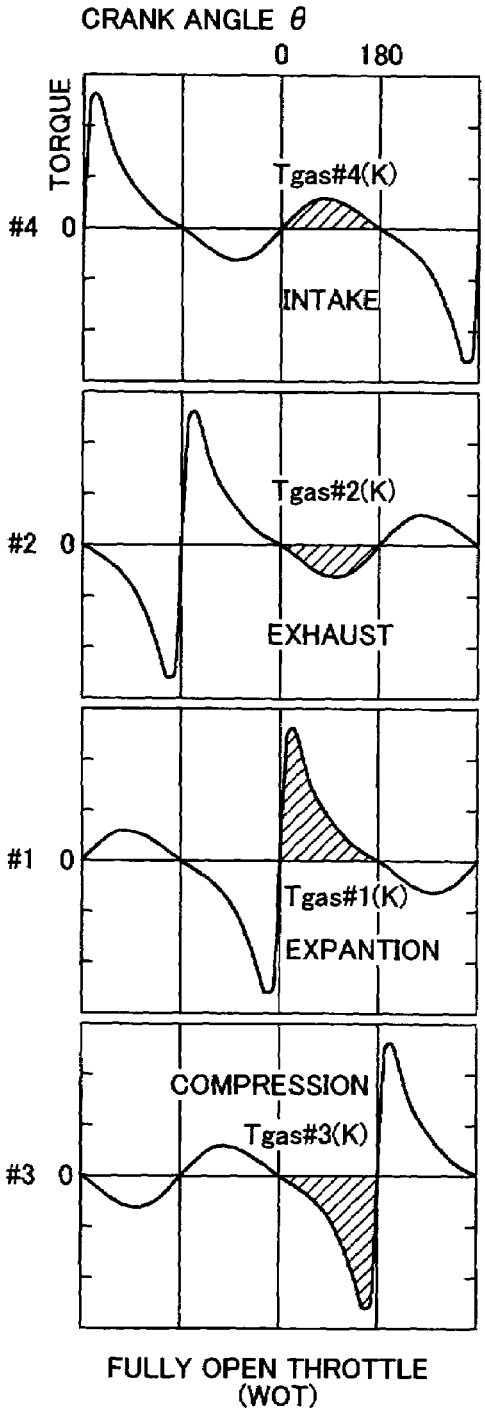
FIG. 16A is a characteristic diagram indicating the torque produced in each cylinder of a four-cylinder engine, illustrating a case where the throttle valve is fully open.
Figure 16B:
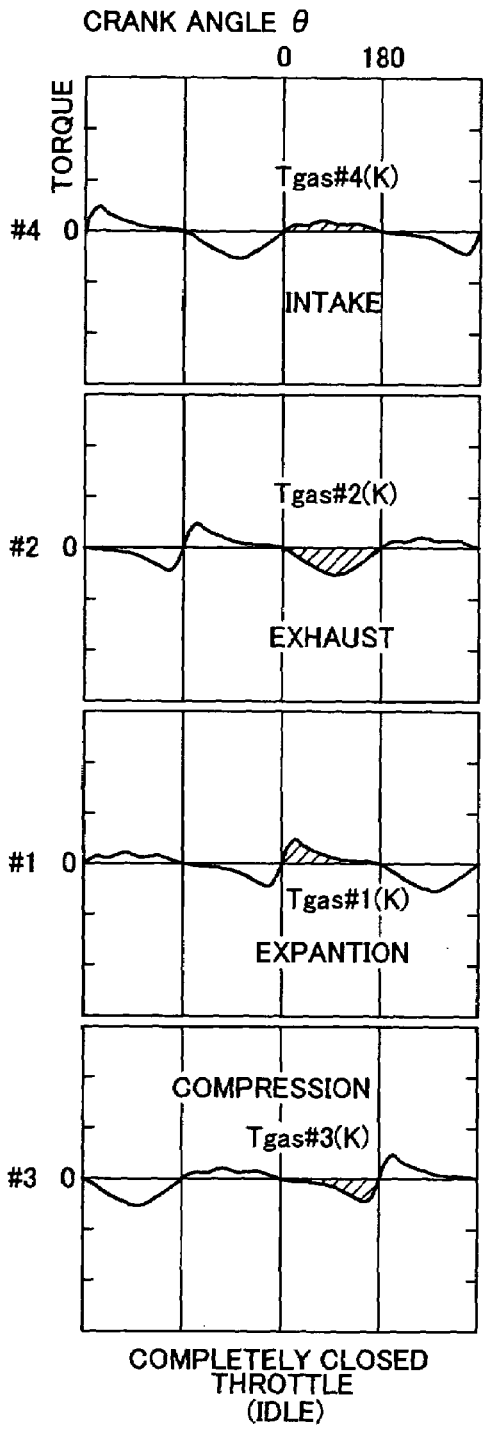
FIG. 16B is a characteristic diagram indicating the torque produced in each cylinder of a four-cylinder engine, illustrating a case where the throttle valve is completely closed.

FIGS. 16A and 16B are characteristic diagrams indicating the torque produced by each of the cylinders #1 to #4. The characteristic diagrams of FIGS. 16A and 16B indicate the torques produced by the cylinders in the case where the cranking is performed by the starter 48 and combustion in the cylinders does not occur, similar to the case of FIGS. 15A and 15B. The characteristic diagrams of FIGS. 16A and 16B indicate the torques calculated from the pressures in the cylinders detected by in-cylinder pressure sensors provided individually for the cylinders. In FIG. 16A, the throttle valve 22 is fully open. In FIG. 16B, the throttle valve 22 is completely closed.

During the fully open state of the throttle valve 22, the works produced during the intake stroke and during the exhaust stroke cancel each other, and the works produced during the compression stroke and during the exhaust stroke also cancel each other, as can be seen from FIG. 16A. In FIG. 16A, during an interval of 0° to 180° in crank angle, the cylinder #4 undergoes the intake stroke, and the cylinder #2 undergoes the exhaust stroke, and the cylinder #1 undergoes the expansion stroke, and the cylinder #3 undergoes the compression stroke. Therefore, the works produced by the cylinders #4 and #2 cancel each other, and the works produced by the cylinders #1 and #3 cancel each other, as mentioned above in conjunction with FIG. 15A. That is, in FIG. 16A, the hatched areas for the cylinders #4 and #2 are equal to each other, and the hatched areas for the cylinders #1 and #3 are equal to each other.

During the completely closed state of the throttle valve 22, the works produced during the compression stroke and during the expansion stroke cancel each other whereas the works produced during the intake stroke and during the exhaust stroke do not cancel each other. That is, while the works produced by the cylinders #1 and #3 cancel each other, the works produced by the cylinders #4 and #2 do not cancel each other. Therefore, the difference between the area of the hatched region for the cylinder #4 and the area of the hatched region for the cylinder #2 indicates the negative amount of work that corresponds to the area $S_1$ indicated in FIG. 15B.

According to the fourth embodiment, the actual friction torque $T_{fw}$ is calculated while the pumping loss indicated in FIGS. 15B and 16B is taken into account. A method for calculating the torque $T_{ipl}(k)$ corresponding to the amount of pumping loss will be described below.

The torque $T_{ipl}(k)$ corresponding to the amount of pumping loss is an amount of work corresponding to the area $S_1$ in FIG. 15B, and is calculated from the difference between the in-cylinder pressure $P_{EXHAUST}$ during the exhaust stroke and the in-cylinder pressure $P_{INTAKE}$ during the intake stroke. Normally, the in-cylinder pressure $P_{INTAKE}$ during the intake stroke can be represented by the intake pipe pressure Pm, and the in-cylinder pressure $P_{EXHAUST}$ is approximately equal to the atmospheric pressure ($=P_{ATMOSPHERIC}$) Therefore, the torque $T_{ipl}(k)$ corresponding to the amount of pumping loss can be calculated as a function of an average intake pipe pressure Pm(k) for a torque calculation interval (every 180° in crank angle) as in an equation (6).

[Math. 6]

$$T_{ipl}(k)=C\times(Pm(k)-P_{ATMOSPHERIC})+D \tag{6}$$

With regard to the equation (6), the average intake pipe pressure Pm(k) for every torque calculation interval is detected via the intake pressure sensor 29 provided on the intake passageway 12. The average intake pipe pressure Pm(k) may also be acquired by other methods. For example, in a method, the average intake pipe pressure Pm(k) is estimated from the amount of intake air (Ga) detected via the air flow meter 20. In another method, the average intake pipe pressure Pm(k) is estimated from the degree of throttle opening and the engine rotation speed. In the equation (6), C and D are predetermined correction factors, and may also be variables that change in accordance with the state of operation (e.g., the average intake pipe pressure, the average engine rotation speed in the torque calculation interval, or the like). As can be understood from the equation (6), the calculation of $Pm(k)-P_{ATMOSPHERIC}$ provides a value corresponding to the difference between the in-cylinder pressure $P_{INTAKE}$ and the in-cylinder pressure $P_{EXHAUST}$, and the multiplication of $(Pm(k)-P_{ATMOSPHERIC})$ by the factor C followed by addition of the factor D provides torque $T_{ipl}(k)$.

In FIG. 15B, the pumping loss caused during a four-stroke cycle is idealized so that the pumping loss corresponds to the rectangular area $S_1$. However, there are cases where the pumping loss cannot be idealized to a rectangular area indicated by $S_1$. In a case, as for example, the beginning of the intake stroke at the point A is not immediately followed by the in-cylinder pressure $P_{INTAKE}$ but is followed by elapse of a predetermined time before the in-cylinder pressure reaches $P_{INTAKE}$, as indicated by a broken line in FIG. 15B. In another case, the beginning of the exhaust stroke at the point D is followed by elapse of a predetermined time before the in-cylinder pressure reaches $P_{EXHAUST}$, as indicated by a broken line in FIG. 15B. In the equation (6), the term $(Pm(k)-P_{ATMOSPHERIC})$ is corrected by the correction factors C, D. Therefore, if the pumping loss is not idealized to the area $S_1$as in the cases indicated by the broken lines in FIG. 15B, the correction via the correction factors C, D allows precise calculation of the pumping loss.

The torque $T_{ipl}(k)$ corresponding to the amount of pumping loss may also be calculated as in an equation (7) below. The equation (7) adopts an average back pressure PACK(k) (average in-cylinder pressure of cylinders undergoing the exhaust stroke in the torque calculation interval) in place of ATMOSPHERIC in the equation (6).

[Math. 7]

$$T_{ipl}(k)=C'\times(Pm(k)-P_{BACK}(k)) \tag{7}$$

The average back pressure $P_{BACK}(k)$ in the equation (7) is determined from a value detected via the exhaust pressure sensor 31 provided on the exhaust passageway 14. In the equation (7), C', similar to the correction factors C, D in the equation (6), is a constant or a variable that changes in accordance with the state of operation. According to the equation (7), the torque $T_{ipl}(k)$ corresponding to the amount of pumping loss is calculated from the average intake pipe pressure Pm(k) and the average back pressure $P_{BACK}(k)$.

The average back pressure $P_{BACK}$ in the equation (7) is closer to the pressure $P_{EXHAUST}$ in FIG. 15B than the pressure $P_{ATMOSPHERIC}$ in the equation (6) is. Therefore, the equation (7) provides higher-precision calculation of torque $T_{ipl}(k)$ due to adoption of the average back pressure $P_{BACK}$. Furthermore, in the equation (7), the torque $T_{ipl}(k)$ is calculated without the use of the factor D in the equation (6), and thus the calculation is simplified.

The following equations (9) to (11) are provided for calculating the torque $T_{ipl}(k)$ corresponding to the amount of pumping loss from simple physical expressions using an instantaneous value ($P_{INTAKE}(\theta)$) of the in-cylinder pressure during the intake stroke or an instantaneous value of the intake pipe pressure ($Pm'(\theta)$), an instantaneous value ($P_{EXHAUST}(\theta)$) or an instantaneous value of the back pressure ($P_{BACK}(\theta)$), and the atmospheric pressure ($P_{ATMOSPHERIC}(\theta)$).

[Math. 8]

$$T_{ipl} = T_{\text{gas_INTAKE}}(k) + T_{\text{gas_EXHAUST}}(k) \tag{8}$$

$$= Average\left(\frac{180}{\pi}\cdot P_{INTAKE}(\theta)\cdot\frac{dV_{INTAKE}(\theta)}{d\theta}\right) + Average\left(\frac{180}{\pi}\cdot P_{EXHAUST}(\theta)\cdot\frac{dV_{EXHAUST}(\theta)}{d\theta}\right) \tag{9}$$

$$= Average\left(\frac{180}{\pi}\cdot Pm'(\theta)\cdot\frac{dV_{INTAKE}(\theta)}{d\theta}\right) + Average\left(\frac{180}{\pi}\cdot P'_{BACK}(\theta)\cdot\frac{dV_{EXHAUST}(\theta)}{d\theta}\right) \tag{10}$$

$$= Average\left(\frac{180}{\pi}\cdot Pm'(\theta)\cdot\frac{dV_{INTAKE}(\theta)}{d\theta}\right) + Average\left(\frac{180}{\pi}\cdot P_{ATMOSPHERIC}(\theta)\cdot\frac{dV_{EXHAUST}(\theta)}{d\theta}\right) \tag{11}$$

In the right-hand side of the equation (8), $T_{gas_INTAKE}(k)$ represents a torque corresponding to the positive amount of torque produced during the intake stroke in the torque calculation interval, and is the positive amount of work corresponding to the area $S_2$ in FIG. 15B. The term $T_{gas_{13}EXHAUST}(k)$ represents a torque corresponding to the negative amount of work produced during the exhaust stroke in the torque calculation interval, and is the negative amount of work corresponding to the area $S_1+S_2$ in FIG. 15B.

In the equation (9), $T_{gas_INTAKE}(k)$ and $T_{gas_EXHAUST}(k)$ are directly calculated from the instantaneous value $P_{INTAKE}(\theta)$ of the in-cylinder pressure during the intake stroke and the instantaneous value $P_{EXHAUST}(\theta)$ of the in-cylinder pressure during the exhaust stroke, respectively. It is desirable that the torque $T_{ipl}(k)$ be determined through the use of the equation (9) if $P_{INTAKE}(\theta)$ and $P_{EXHAUST}(\theta)$ can be accurately acquired from the in-cylinder pressure sensors provided for the individual cylinders or the like. As expressed in the equation (9), $T_{gas_{13}TAKE}(k)$ is calculated from an average value of the multiplication product of $180/\pi$, the instantaneous value $P_{INTAKE}(\theta)$ of the in-cylinder pressure during the intake stroke, and the amount of change in the cylinder capacity $dV(\theta)/d\theta$ during the intake stroke, that is, $Average((180/\pi)\times P_{INTAKE}(\theta)\times(dV_{INTAKE}(\theta)/d\theta))$. $T_{gas_EXAUT}(k)$ is calculated from an average value of the multiplication product of $180/\pi$, the instantaneous value $P_{EXHAUST}(\theta)$ of the in-cylinder pressure during the exhaust stroke, and the amount of change in the cylinder capacity $dV(\theta)/d\theta$ during the exhaust stroke, that is, $Average((180/\pi)\times P_{EXHAUST}(\theta)\times(dV_{EXHAUST}(\theta)/d\theta))$.

In the equation (9), $P_{INTAKE(\theta)\times(dVINTAKE}(\theta)/d\theta)$ is a value corresponding to the in-cylinder torque produced at the time point of the crank angle θ during the intake stroke and, in FIG. 16B, corresponds to the in-cylinder torque produced at the time point of crank angle θ by the cylinder #4 undergoing the intake stroke. Therefore, $Average((180/\pi)\times P_{INTAKE}(\theta)\times(dV_{INTAKE}(\theta)/d\theta))$ corresponds to a value obtained by averaging the varying values of the in-cylinder torque during the intake stroke and, in FIG. 16B, corresponds to a value obtained by averaging the varying values of the in-cylinder torque produced in the intake stroke of the cylinder #4. In the foregoing equations, $180/\pi$is a factor to multiply for the purpose of unit agreement. Similarly, $P_{EXHAUST}(\theta)\times(dV_{EXHAUST}(\theta)/d\theta)$ is a value corresponding to the in-cylinder torque produced at the time point of crank angle θ during the exhaust stroke and, in FIG. 16B, corresponds to the in-cylinder torque produced at the time point of crank angle θ by the cylinder #2 undergoing the exhaust stroke. Therefore, $Average((180/\pi)\times P_{EXHAUST}(\theta)\times(dV_{EXHAUST}(\theta)/d\theta))$ corresponds to a value obtained by averaging the varying values of the in-cylinder torque during the exhaust stroke and, in FIG. 16B, corresponds to a value obtained by averaging the varying values of the in-cylinder torque produced in the exhaust stroke of the cylinder #2.

Thus, by calculating $T_{gas_INTAKE}(k)$ and $T_{gas_EXHAUST}(k)$ from the instantaneous value $P_{INTAKE}(\theta)$ of the in-cylinder pressure during the intake stroke and the instantaneous value $P_{EXHAUST}(\theta)$ of the in-cylinder pressure during the exhaust stroke, respectively, it becomes possible to precisely calculate the torque $T_{ipl}(k)$ corresponding to the amount of pumping loss on the basis of the torque produced in the cylinders.

In the equation (10), $T_{ipl}(k)$ is calculated by using the instantaneous value $Pm'(\theta)$ of the intake pipe pressure in place of the $P_{INTAKE}(\theta)$ in the equation (9) and using the instantaneous value $P_{BACK}'(\theta)$ of the back pressure in place of the $P_{EXHAUST}(\theta)$ in the equation (9). The instantaneous value $Pm'(\theta)$ of the intake pipe pressure is acquired from the intake pressure sensor 29, and the instantaneous value $P_{BACK}'(\theta)$ of the back pressure is acquired from the exhaust pressure sensor 31. According to the equation (10), there is no need to provide an in-cylinder pressure sensor, and the torque $T_{ipl}(k)$ can be calculated on the basis of the $Pm'(\theta)$ and the $P_{BACK}'(\theta)$.

In the equation (11), $T_{ipl}(k)$ is calculated by using the atmospheric pressure $P_{ATMOSPHERIC}(\theta)$ in place of the instantaneous value $P_{BACK}'(\theta)$ of the back pressure in the equation (10). Therefore, according to the equation (11), it becomes possible to calculate $T_{ipl}(k)$ on the basis of $P_{ATMOSPHERIC}(\theta)$ without determining the instantaneous value $P_{BACK}'(\theta)$ of the back pressure.

The torque $T_{ipl}(k)$ corresponding to the amount of pumping loss may also be acquired from a map stored in the ECU 40. In an example, a map in which a relationship among the torque $T_{ipl}(k)$ corresponding to the amount of pumping loss, the interval average engine rotation speed and the average intake pipe pressure in the torque calculation interval is defined is pre-stored in the ECU 40, and $T_{ipl}(k)$ is acquired from this map.

After the torque $T_{ipl}(k)$ corresponding to the amount of pumping loss is calculated by a method as described above, the actual friction torque $T_{fw}$ is calculated using $T_{ipl}(k)$. Specifically, if the actual friction torque $T_{fw}$ is calculated while the pumping loss is taken into account according to Embodiment 1, the torque $T_{ipl}(k)$ corresponding to the amount of pumping loss is added to $W_e$ in the left-hand side of the equation (3). In this manner, the amount of reduction caused by the torque $T_{ipl}(k)$ corresponding to the amount of pumping loss with respect to the average value $W_e$ of the electric energy supplied to the starter 48 can be factored in, so that the precision in the calculation of the actual friction torque $T_{fw}$ in the right-hand side of the equation (3) can be improved. If the actual friction torque $T_{fw}$ is calculated while the amount of pumping loss is taken into account in the second or third method, the torque $T_{ipl}(k)$ corresponding to the amount of pumping loss is added to the left-hand side of the equation (5). Therefore, it becomes possible to calculate the actual friction torque $T_{fw}$ in the right-hand side of the equation (5) while factoring in the torque $T_i$ p,(k) corresponding to the amount of pumping loss. It is to be noted herein that $T_{ipl}(k)$ added in the equations (3) and (5) is a negative value corresponding to the area $S_1$ indicated in FIG. 15B.

Figure 17:
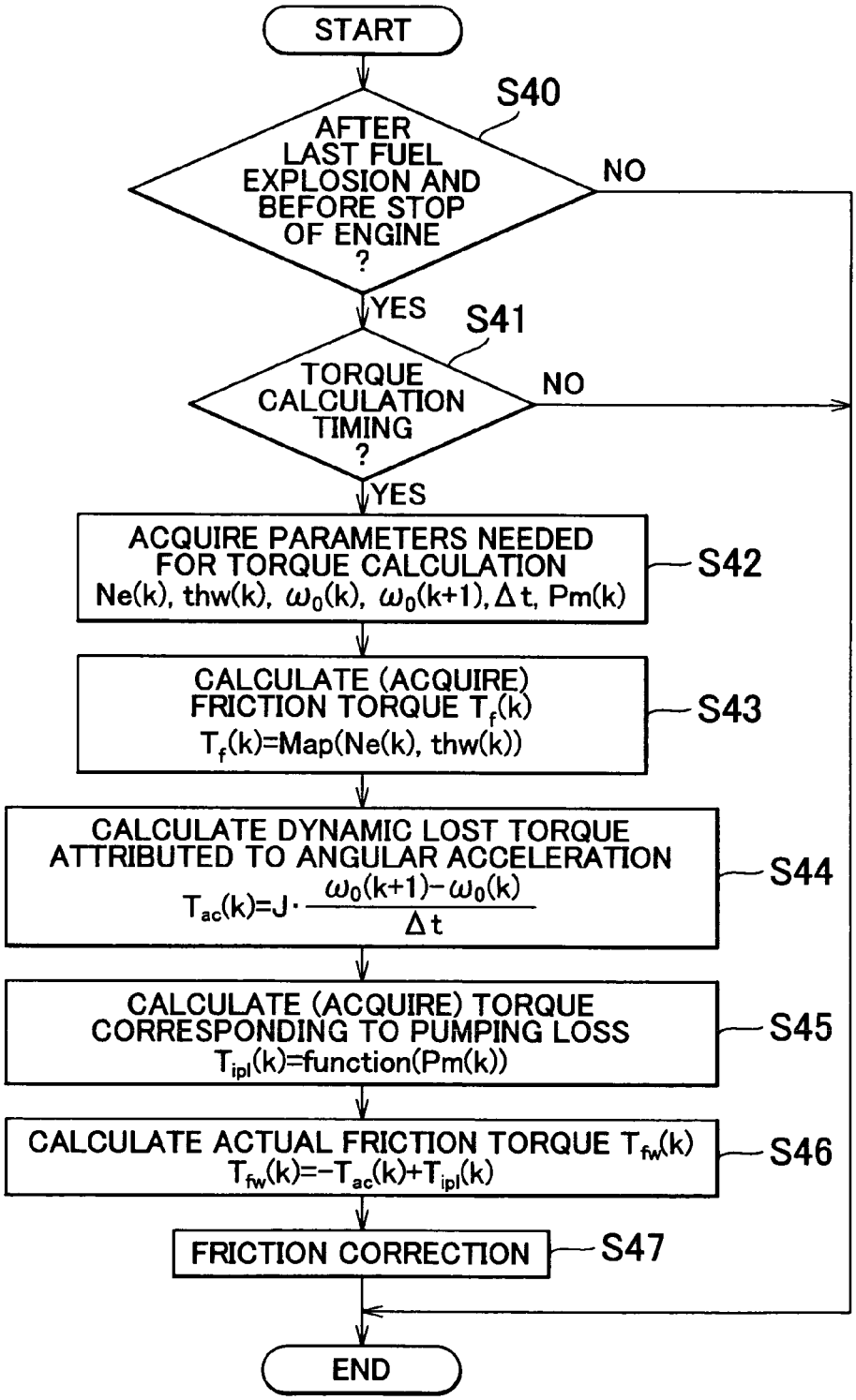
FIG. 17 is a flowchart illustrating the procedure of a process according to a fourth method for friction torque correction.

The procedure of a process in the fourth method will be described with reference to a flowchart shown in FIG. 17. The flowchart of FIG. 17 illustrates a process in which the amount of pumping loss is taken into account in the correction of friction torque in the second method.

First in step S40, it is determined whether it is presently the time to calculate a friction torque at the time of stop of the engine. Specifically, it is determined whether the present time is after the change of the ignition switch 46 from the on-state to the off-state and after the last explosion of fuel. If it is presently the time to calculate friction torque at the time of stop of the engine, the process proceeds to step S41. Conversely, if it is presently not the time to calculate friction torque, the process ends.

In step S41, it is determined whether the present crank angle position coincides with the timing to calculate the lost torque $T_{ac}$. Specifically, it is determined whether the present crank angle is in either the state where the crank angle is equal to or greater than TDC+10° or the state where the crank angle is equal to or greater than BDC+10°. If the present crank angle coincides with the torque calculation timing, the process proceeds to step S42. If the present crank angle does not coincide with the torque calculation timing, the process ends.

In step S42, parameters needed for the calculation of torque are acquired. Specifically, the parameters acquired include the engine rotation speed (Ne(k)), the coolant temperature (thw(k)), the angular speeds ($\omega_0(k)$, $\omega_0(k+1)$), the time ($\Delta t$), etc.

Subsequently in step S43, a friction torque $T_f(k)$ is estimated from the map shown in FIG. 4. In this case, the friction torque $T_f(k)$ is determined from the map of FIG. 4 through the use of the engine rotation speed (Ne(k)) and the coolant temperature (thw(k)) acquired in step S42.

Subsequently in step S44, the dynamic lost torque $T_{ac}(k)$ attributed to angular acceleration is calculated. In this case, the average value $T_{ac}(k)$ of dynamic lost torque in the TDC-BDC interval is determined through the calculation of $T_{ac}(k)=J\times((\omega_0(k+1)-\omega_0(k))/\Delta t)$.

Subsequently in step S45, the pumping loss is calculated. In this step, the torque $T_{ipl}(k)$ corresponding to the amount of pumping loss is calculated using the equation (6). Subsequently in step S46, the actual friction torque $T_{fw}(k)$ is determined by subtracting the lost torque $T_{ac}(k)$ from the torque $T_{ipl}(k)$ corresponding to the amount of pumping loss. If the actual friction torque $T_{fw}(k)$ is calculated while the torque $T_{ipl}(k)$ corresponding to the amount of pumping loss is taken into account in Embodiment 2, $T_{ipl}(k)$ is added to the left-hand side of the equation (5), so that the actual friction torque $T_{fw}(k)$ is calculated as the difference between the lost torque $T_{ac}(k)$ and the torque $T_{ipl}(k)$ corresponding to the amount of pumping loss.

Subsequently in step S47, the friction torque $T_f$ of the map of FIG. 4 is corrected. Specifically, the actual friction torque $T_{fw}(k)$ determined in step S46 is compared with the friction torque $T_f(k)$ determined in step S43 . If there is a difference between the two friction torques, the map shown in FIG. 4 is corrected through the use of the actual friction torque $T_{fw}(k)$ determined in step S46. After the friction torque $T_f$ is corrected in step S47, the process ends.

Although in the process illustrated by the flowchart of FIG. 17, the correction of friction torque factoring in the pumping loss is applied to the second method, the correction of friction torque factoring in the pumping loss may also be applied to the first and third methods as mentioned above.

According to the fourth method, the torque $T_{ipl}(k)$ corresponding to the amount of pumping loss is taken into account in the calculation of the actual friction torque Tfw(k), so that the friction characteristic of the map shown in FIG. 4 can be corrected with high precision. Therefore, it becomes possible to calculate a characteristic value, such as the indicated torque or the like, with high precision.

A fifth method for correction of the friction torque $T_f$ will next be described. In Embodiment 5, the amount of intake air is controlled so as to minimize the pumping loss.

As mentioned above in conjunction with the fourth method, a pumping loss in the intake passageway 12 affect the precision in calculation of the actual friction torque $T_{fw}(k)$ in some cases. In the fifth method, if the actual friction torque Tfw(k) is determined at the stop of the engine as in the second method, the throttle valve 22 is fully opened to minimize occurrence of a pumping loss.

The procedure of a process in the fifth method will be described with reference to a flowchart shown in FIG. 18. First in step S51, it is determined whether it is presently the time to calculate a friction torque at the time of stop of the engine. Specifically, it is determined whether the present time is after the change of the ignition switch 46 from the on-state to the off-state and after the last explosion of fuel. If it is presently the time to calculate friction torque at the time of stop of the engine, the process proceeds to step S52. Conversely, if it is presently not the time to calculate friction torque, the process ends.

Figure 13:
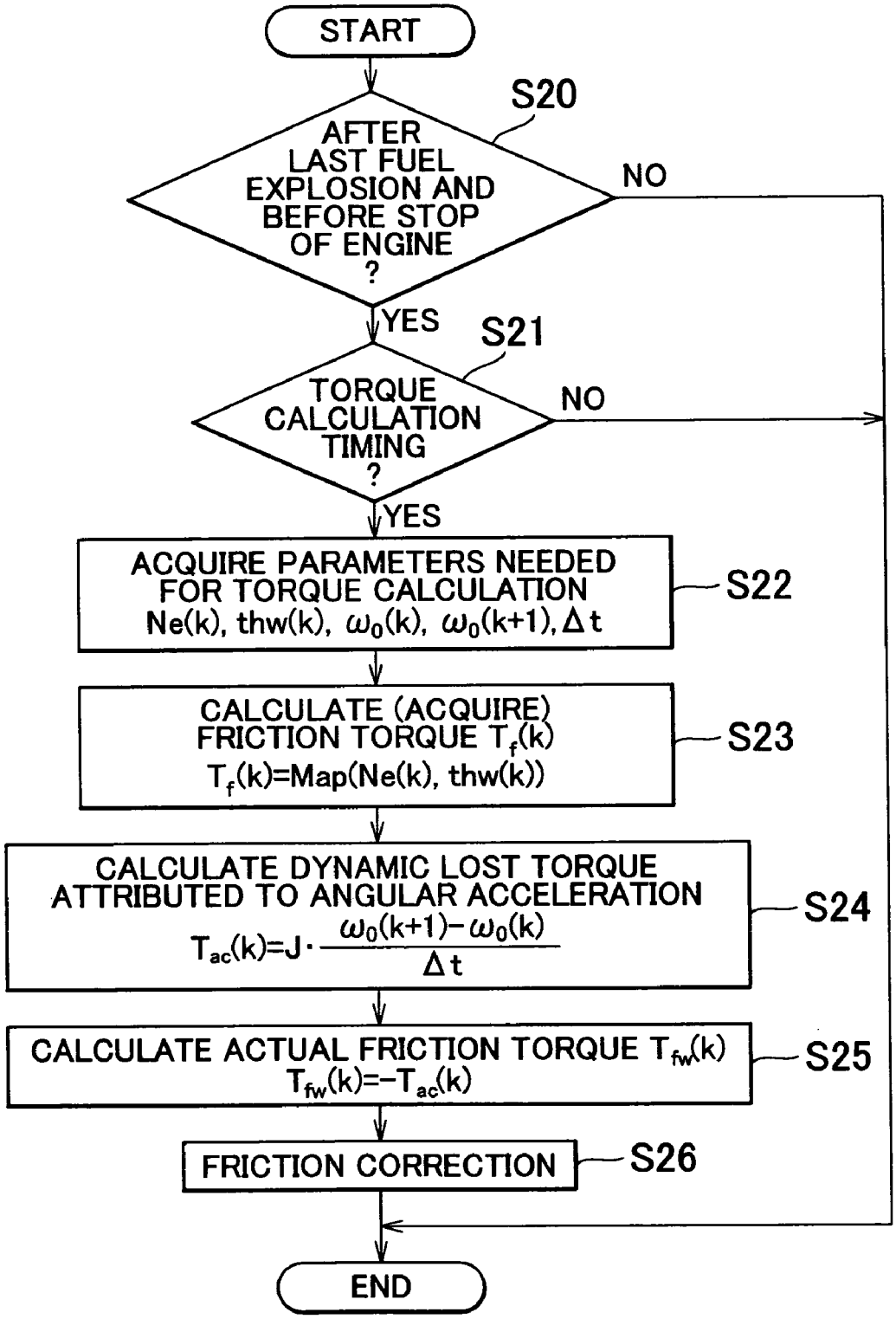
FIG. 13 is a flowchart illustrating the procedure of a process according to a second method for friction torque correction.

In step S52, the throttle valve 22 is fully opened in accordance with a command from the ECU 40. Subsequently in step S53, it is determined whether it is presently the timing to calculate the lost torque. The processing of step S53 is substantially the same as the processing of step S21 in FIG. 13. If it is determined in step S53 that it is presently the torque calculation timing, the process proceeds to step S54, in which a friction correction logic is executed. That is, in step S54, the process of steps S22 to S26 in FIG. 13 is executed. After the friction correction logic is executed in step S54, the process ends.

Figure 18:
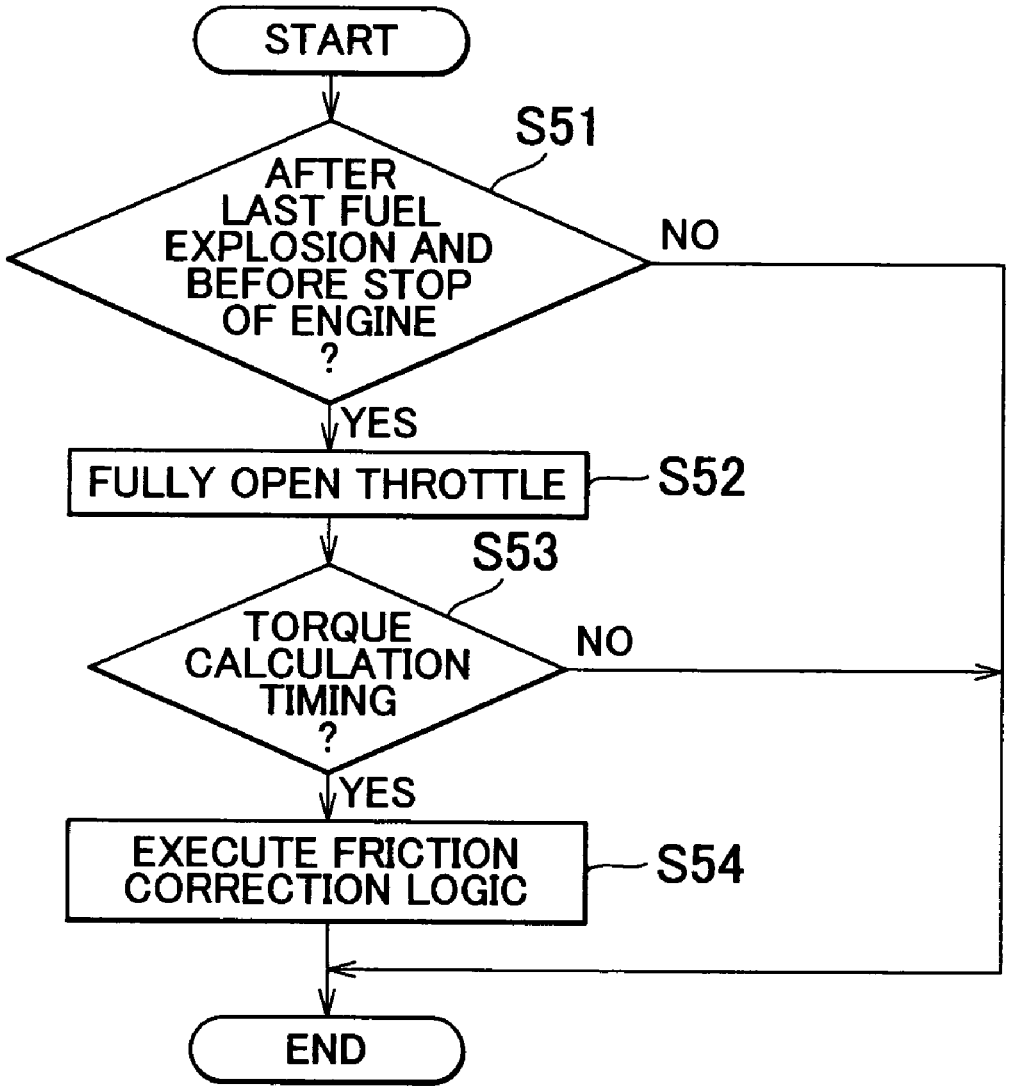
FIG. 18 is a flowchart illustrating the procedure of a process according to a fifth method for friction torque correction.

According to the process illustrated in FIG. 18, the throttle valve 22 is fully opened if it is determined that it is presently the time to calculate a friction torque at the time of stop of the engine. Therefore, the amount of air taken into the cylinders can be controlled. Hence, it becomes possible to minimize occurrence of a pumping loss in the intake passageway 12. Furthermore, according to the process illustrated in FIG. 18, the influence of the pumping loss on the precision in calculation of the actual friction torque $T_{fw}$ can be minimized by executing the friction correction logic while the throttle valve 22 is kept fully open as in the second method. Therefore, the friction characteristic of the map can be corrected with high precision. Hence, it becomes possible to calculate a characteristic value, such as the indicated torque or the like, with high precision.

Although in the fifth method, the amount of intake air is controlled at the time of stop of the engine by fully opening the throttle valve 22, the amount of intake air may also be controlled by other methods, for example, a method in which the lift of the intake valves is controlled, or the like.

The control of the amount of intake air in Embodiment 5 may also be applied to the friction torque correction in the first and third methods. Furthermore, the control of the amount of intake air in Embodiment 5 may be employed in a combination with the friction torque correction factoring in the pumping loss according to the fourth method.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. A combustion state estimating apparatus for estimating a state of combustion in an internal combustion engine, comprising a control system that:

determines a crank angle acceleration; and estimates the state of combustion in the internal combustion engine based on the crank angle acceleration determined for a crank angle interval in which an average value of inertia torque caused by a reciprocating inertia mass of the internal combustion engine is substantially zero.

2. The combustion state estimating apparatus according to claim 1, wherein the control system determines an average value of the crank angle acceleration for the crank angle interval, and wherein the control system estimates the state of combustion in the internal combustion engine based on the average value of the crank angle acceleration.

3. The combustion state estimating apparatus according to claim 2, wherein the control system detects crank angle speeds at two ends of the crank angle interval, and wherein the control system determines the average value of the crank angle acceleration from a duration of rotation of a crankshaft for the crank angle interval and from the crank angle speeds detected at the two ends of the crank angle interval.

4. The combustion state estimating apparatus according to claim 1, wherein the control system determines a dynamic lost torque attributed to the crank angle acceleration, based on an inertia moment of a driving portion and the crank angle acceleration in the crank angle interval, and wherein the control system estimates the state of combustion in the internal combustion engine based on the dynamic lost torque.

5. The combustion state estimating apparatus according to claim 4, wherein the control system determines an average value of the dynamic lost torque in the crank angle interval, and wherein the control system estimates the state of combustion in the internal combustion engine based on the average value of the dynamic lost torque.

6. The combustion state estimating apparatus according to claim 5, wherein the control system:

determines a friction torque of the driving portion in the crank angle interval;

determines an average value of the friction torque in the crank angle interval, and estimates the state of combustion in the internal combustion engine based on the average value of the dynamic lost torque and the average value of the friction torque.

7. The combustion state estimating apparatus according to claim 6, control system determines the average value of the friction torque based on an average value of rotation speed of the internal combustion engine in the crank angle interval and an average value of coolant temperature in the crank angle interval.

8. The combustion state estimating apparatus according to claim 6, wherein the control system:

determines the crank angle acceleration while torque generation caused by combustion is stopped, determines the dynamic lost torque based on the crank angle acceleration and an inertia moment of the internal combustion engine, and stores a standard friction torque characteristic that defines a relationship between a predetermined parameter and a friction torque of the internal combustion engine, and determines an actual friction torque that occurs in the internal combustion engine, based on the dynamic lost torque, and acquires a correction friction torque based on the actual friction torque and the standard friction torque characteristic.

9. The combustion state estimating apparatus according to claim 8, wherein the control system determines a supplied energy that is supplied to a starter for starting up the internal combustion engine, and determines the crank angle acceleration during a period from a startup of the internal combustion engine until a first fuel explosion, and determines the actual friction torque based on the dynamic lost torque and the supplied energy.

10. The combustion state estimating apparatus according to claim 8, wherein the control system determines the crank angle acceleration during a period starting after an ignition switch for changing a state of operation/stop of the internal combustion engine is changed from an operation state to a stop state and ending when the internal combustion engine stops.

11. The combustion state estimating apparatus according to claim 10, wherein the control system controls an amount of intake air so that the amount of intake air increases after the ignition switch is changed from the operation state to the stop state.

12. The combustion state estimating apparatus according to claim 8, wherein the control system stops a combustion-caused torque generation by stopping fuel injection or fuel ignition at an arbitrary timing during an operation of the internal combustion engine, and wherein the control system determines the crank angle acceleration at the timing while the combustion-caused torque generation is stopped.

13. The combustion state estimating apparatus according to claim 8, wherein the control system detects a crank angle speed, and wherein the control system determines the crank angle acceleration from a duration of rotation of a crankshaft for a predetermined interval and crank angle speeds detected at two ends of the predetermined interval.

14. The combustion state estimating apparatus according to claim 13, wherein the predetermined interval is an interval whose two ends are a top dead center and a bottom dead center.

15. The combustion state estimating apparatus according to claim 8, wherein the control system:

determines an intake pressure of the internal combustion engine;

determines a pumping loss in an intake passage based on the intake pressure, and corrects the actual friction torque based on the pumping loss.

16. The combustion state estimating apparatus according to claim 5, wherein the control system determines an average value of the crank angle acceleration in the crank angle interval, and determines the average value of the dynamic lost torque based on the average value of the crank angle acceleration and the inertia moment of the driving portion.

17. The combustion state estimating apparatus according to claim 16, wherein the control system detects crank angle speeds at two ends of the crank angle interval, and determines the average value of the crank angle acceleration from a duration of rotation of a crankshaft for the crank angle interval and from the crank angle speeds detected at the two ends of the crank angle interval.

18. The combustion state estimating apparatus according to claim 4, wherein the control system determines a friction torque of the driving portion in the crank angle interval, and wherein the control system estimates the state of combustion in the internal combustion engine based on the friction torque and the dynamic lost torque.

19. The combustion state estimating apparatus according to claim 18, wherein the friction torque includes friction torque of an accessory.

20. The combustion state estimating apparatus according to claim 1, wherein the state of combustion in the internal combustion engine is a quality of the combustion in the internal combustion engine.

* * * * *